US009914003B2

(12) United States Patent
Kuehne et al.

(10) Patent No.: US 9,914,003 B2
(45) Date of Patent: Mar. 13, 2018

(54) MONOCOLUMN UNWEIGHTING SYSTEMS

(71) Applicant: AlterG, Inc., Fremont, CA (US)

(72) Inventors: Eric R. Kuehne, Los Gatos, CA (US); Clifford T. Jue, Santa Cruz, CA (US)

(73) Assignee: AlterG, Inc., Fremont, CA (US)

( * ) Notice: Subject to any disclaimer, the term of this patent is extended or adjusted under 35 U.S.C. 154(b) by 0 days.

(21) Appl. No.: 14/769,115

(22) PCT Filed: Mar. 5, 2014

(86) PCT No.: PCT/US2014/020863

§ 371 (c)(1),
(2) Date: Aug. 20, 2015

(87) PCT Pub. No.: WO2014/138281

PCT Pub. Date: Sep. 12, 2014

(65) Prior Publication Data

US 2016/0001118 A1 Jan. 7, 2016

Related U.S. Application Data

(60) Provisional application No. 61/773,037, filed on Mar. 5, 2013.

(51) Int. Cl.
*A63B 26/00* (2006.01)
*A63B 21/00* (2006.01)
(Continued)

(52) U.S. Cl.
CPC ..... *A63B 21/00181* (2013.01); *A61H 3/00* (2013.01); *A63B 21/00058* (2013.01);
(Continued)

(58) Field of Classification Search
CPC ..... A63B 21/078; A63B 21/0783; A63B 21/0626; A63B 21/00181; A63B 21/023
See application file for complete search history.

(56) References Cited

U.S. PATENT DOCUMENTS 32,109 A 4/1861 DeBrame
43,972 A 8/1864 Coldwell
(Continued)

FOREIGN PATENT DOCUMENTS

CA 2216216 A 5/1999
DE 02623091 A1 11/1977
(Continued)

OTHER PUBLICATIONS http://www.motioncontroltips.com/lead-screws/—pub. Oct. 4, 2011, last visited Dec. 19, 2016.*
(Continued)

*Primary Examiner* — Loan H Thanh
*Assistant Examiner* — Rae Fischer
(74) *Attorney, Agent, or Firm* — Shay Glenn LLP

(57) ABSTRACT

An unweighting system includes a frame having a base and a vertical bar extending therefrom. The base is configured to connect to or at least partially encircle an exercise device. A height adjustable cantilevered arm assembly is coupled to the vertical bar at a fulcrum, and the cantilevered arm assembly is configured to receive and couple to the user. A resilient member is coupled to the cantilevered arm assembly and configured to unload a portion of the user's weight while the user is coupled to the cantilevered arm assembly and exercises on the exercise device.

13 Claims, 17 Drawing Sheets

(51) Int. Cl.

| | |
|---|---|
| ***A63B 22/02*** | (2006.01) |
| ***A63B 69/00*** | (2006.01) |
| ***A61H 3/00*** | (2006.01) |
| ***A63B 22/00*** | (2006.01) |
| ***A63B 23/04*** | (2006.01) |
| ***A63B 71/00*** | (2006.01) |

(52) U.S. Cl.

CPC ..... *A63B 21/4009* (2015.10); *A63B 22/0046* (2013.01); *A63B 22/0048* (2013.01); *A63B 22/02* (2013.01); *A63B 23/04* (2013.01); *A63B 69/0064* (2013.01); *A63B 71/0009* (2013.01)

(56) References Cited

U.S. PATENT DOCUMENTS 68,637 A 9/1867 Mason
76,053 A 3/1868 Colwell
217,918 A 7/1879 White
219,439 A 9/1879 Blend
458,136 A 8/1891 Wilder
823,812 A 6/1906 Ritter
1,193,374 A 8/1916 Gilliam
1,223,707 A 4/1917 Lyon
1,507,554 A 9/1924 Cooper
1,553,520 A 9/1925 Dougherty
1,578,852 A 3/1926 Schmutzer
1,580,508 A 4/1926 Liles
1,586,254 A 5/1926 Lovejoy
2,050,500 A 8/1936 Osborn
2,108,566 A 2/1938 Brooke
2,109,188 A 2/1938 Elizaveta
2,327,671 A 8/1943 Rupprecht
2,438,979 A 4/1948 Lea
2,719,568 A 10/1955 Webb
2,785,004 A 3/1957 Cooper
2,819,755 A 1/1958 Harold et al.
2,871,915 A 2/1959 Hogan
2,892,455 A 6/1959 Hutton
2,991,523 A 7/1961 Del Conte
3,085,357 A 4/1963 Nissen et al.
3,140,869 A 7/1964 Pacuk
3,165,314 A 1/1965 Clearman et al.
3,176,793 A 4/1965 Roland
3,252,704 A 5/1966 Louise
3,730,587 A 5/1973 Bloxham et al.
3,738,027 A 6/1973 Schoch
3,747,596 A 7/1973 Mills
3,778,052 A 12/1973 Andow et al.
3,824,994 A 7/1974 Soderberg, Sr.
4,205,839 A 6/1980 Best
4,211,426 A 7/1980 Motloch
4,479,646 A 10/1984 Beistegui Chirapozu
4,551,108 A 11/1985 Bass
4,655,447 A 4/1987 Dubrinsky et al.
4,731,882 A 3/1988 Ekman
4,805,601 A 2/1989 Eischen, Sr.
4,861,021 A 8/1989 Edwards et al.
4,863,163 A 9/1989 Wehrell
4,911,426 A 3/1990 Scales
4,921,245 A 5/1990 Roberts
4,922,426 A 5/1990 Obara et al.
4,941,497 A 7/1990 Prather et al.
4,961,544 A 10/1990 Bidoia
4,961,573 A 10/1990 Wehrell
4,968,028 A 11/1990 Wehrell
4,976,623 A 12/1990 Owsley
5,000,440 A 3/1991 Lynch
5,029,579 A 7/1991 Trammel
5,048,836 A 9/1991 Bellagamba
5,064,193 A 11/1991 Sainte et al.
5,070,816 A 12/1991 Wehrell
5,156,549 A 10/1992 Wehrell
5,174,590 A 12/1992 Kerley et al.
5,176,597 A 1/1993 Bryne
5,221,241 A 6/1993 Bare
5,273,502 A 12/1993 Kelsey et al.
5,275,426 A 1/1994 Tankersley
5,288,283 A 2/1994 Meeker
5,348,035 A 9/1994 Porter
5,360,384 A 11/1994 Toensing
5,362,298 A 11/1994 Brown et al.
5,372,561 A 12/1994 Lynch
5,391,115 A 2/1995 Bessey
5,398,678 A 3/1995 Gamow
5,403,253 A 4/1995 Gaylord
5,403,270 A 4/1995 Schipper
5,435,798 A 7/1995 Habing et al.
5,512,029 A 4/1996 Barnard et al.
5,526,893 A 6/1996 Higer
5,569,129 A 10/1996 Seif Naraghi et al.
5,577,984 A 11/1996 Bare, II
5,593,368 A 1/1997 Checketts
5,601,527 A 2/1997 Selkowitz
5,603,677 A 2/1997 Sollo
5,626,540 A 5/1997 Hall
5,662,560 A 9/1997 Svendsen et al.
5,667,461 A 9/1997 Hall
5,671,822 A 9/1997 Phillips
5,695,432 A 12/1997 Soderlund
5,704,880 A 1/1998 Amatulle
5,704,881 A 1/1998 Dudley
5,738,616 A * 4/1998 Robertson ..... A63B 21/154 482/102
5,788,606 A 8/1998 Rich
5,816,983 A 10/1998 Dawes et al.
5,857,944 A 1/1999 Cone et al.
5,876,311 A 3/1999 Coates et al.
5,893,367 A 4/1999 Dubats et al.
5,919,119 A 7/1999 Bohmer et al.
5,919,419 A 7/1999 Majuri
5,921,892 A 7/1999 Easton
5,960,480 A 10/1999 Neustater et al.
6,093,024 A 7/2000 Sokolowski
6,120,418 A 9/2000 Plough
6,128,782 A 10/2000 Young et al.
6,146,315 A 11/2000 Schonenberger
6,158,389 A 12/2000 Wehrell
6,217,493 B1 4/2001 Spletzer
6,223,854 B1 5/2001 Nolz
6,244,379 B1 6/2001 Larson
6,261,205 B1 * 7/2001 Elefson ..... A63B 21/00181 482/135
6,270,414 B2 8/2001 Roelofs
6,273,844 B1 8/2001 Kelsey et al.
6,280,361 B1 8/2001 Harvey et al.
6,405,685 B1 6/2002 Cox
6,436,009 B1 8/2002 Marucci
6,438,756 B1 8/2002 Colorado
6,482,128 B1 11/2002 Michalow
6,490,733 B1 12/2002 Casaubon
6,494,811 B1 * 12/2002 Alessandri ..... A63B 21/0628 482/8
6,527,285 B1 3/2003 Calandro, II
6,554,747 B1 4/2003 Rempe
6,578,594 B1 6/2003 Bowen et al.
6,612,845 B1 9/2003 Macri et al.
6,645,126 B1 11/2003 Martin et al.
6,648,411 B2 11/2003 Julien
6,666,801 B1 12/2003 Michalow
6,669,605 B2 12/2003 Scates
6,679,510 B2 1/2004 Perena
6,689,075 B2 * 2/2004 West ..... A61F 5/0102 482/69
6,742,523 B2 6/2004 Dubats
6,783,482 B2 8/2004 Oglesby et al.
6,821,233 B1 11/2004 Colombo et al.
6,892,403 B2 5/2005 Liljedahl
6,918,858 B2 7/2005 Watterson et al.
6,932,709 B1 8/2005 Gubitosi et al.
6,935,353 B2 8/2005 Hawkes et al.
6,966,870 B2 11/2005 Lan
6,988,951 B1 1/2006 Newman et al.
7,166,064 B2 1/2007 Watterson et al.

(56) References Cited

U.S. PATENT DOCUMENTS

| | | | |
|---|---|---|---|
| 7,240,621 | B2 | 7/2007 | Chepurny et al. |
| 7,278,958 | B2 | 10/2007 | Morgan |
| 7,294,094 | B1 | 11/2007 | Howle |
| 7,341,543 | B2 | 3/2008 | Dandy |
| 7,381,163 | B2 | 6/2008 | Gordon et al. |
| 7,472,964 | B2 | 1/2009 | King |
| 7,494,453 | B2 | 2/2009 | Wehrell |
| 7,544,172 | B2 | 6/2009 | Santos-Munne et al. |
| 7,572,190 | B2 | 8/2009 | Habing |
| 7,572,209 | B2 | 8/2009 | Brennan |
| 7,591,795 | B2 | 9/2009 | Whalen et al. |
| 7,594,281 | B1 | 9/2009 | Stinson et al. |
| 7,608,025 | B1 | 10/2009 | Best |
| 7,614,991 | B2 | 11/2009 | Fox |
| 7,625,320 | B2 | 12/2009 | Wehrell |
| 7,651,450 | B2 | 1/2010 | Wehrell |
| 7,666,126 | B2 | 2/2010 | Rempe |
| 7,727,076 | B2 | 6/2010 | Bapst et al. |
| 7,780,587 | B2 | 8/2010 | Thornton et al. |
| 7,785,242 | B2 | 8/2010 | Solomon |
| 7,837,597 | B2 | 11/2010 | Reyes et al. |
| 7,850,629 | B2 | 12/2010 | Ravikumar |
| 7,857,731 | B2 | 12/2010 | Hickman et al. |
| 7,862,478 | B2 | 1/2011 | Watterson et al. |
| 7,874,223 | B2 * | 1/2011 | Sugar ..... B25J 19/0016 248/571 |
| 7,883,450 | B2 | 2/2011 | Hidler |
| 7,887,471 | B2 | 2/2011 | McSorley |
| 7,914,420 | B2 | 3/2011 | Daly et al. |
| 7,938,756 | B2 | 5/2011 | Rodetsky et al. |
| 7,955,219 | B2 | 6/2011 | Birrell et al. |
| 7,998,040 | B2 | 8/2011 | Kram et al. |
| 8,083,643 | B2 | 12/2011 | Ng et al. |
| 8,109,478 | B2 | 2/2012 | Tristao |
| 8,152,699 | B1 | 4/2012 | Ma et al. |
| 8,221,293 | B2 | 7/2012 | Hoffman et al. |
| 8,246,354 | B2 | 8/2012 | Chu et al. |
| 8,251,863 | B2 | 8/2012 | Faulring et al. |
| 8,425,620 | B2 | 4/2013 | Johnson et al. |
| 8,447,401 | B2 | 5/2013 | Miesel et al. |
| 8,464,716 | B2 | 6/2013 | Kuehne et al. |
| 8,470,051 | B2 | 6/2013 | Moyer et al. |
| 8,480,602 | B1 | 7/2013 | Cook |
| 8,656,516 | B1 | 2/2014 | Reinhardt Rawlings et al. |
| 8,840,572 | B2 | 9/2014 | Whalen et al. |
| 8,888,664 | B1 | 11/2014 | Butler |
| 8,968,163 | B1 | 3/2015 | Vidmar |
| 9,314,393 | B2 | 4/2016 | Kim et al. |
| 9,370,680 | B1 | 6/2016 | Macaulay et al. |
| 9,713,439 | B1 | 7/2017 | Wu et al. |
| 2002/0010056 | A1 | 1/2002 | Borsheim |
| 2002/0022554 | A1 | 2/2002 | Borsheim |
| 2002/0032103 | A1 | 3/2002 | Cook |
| 2002/0065173 | A1 | 5/2002 | Cook |
| 2004/0212240 | A1 | 10/2004 | Zwezdaryk |
| 2004/0245298 | A1 | 12/2004 | Refsum |
| 2005/0026757 | A1 | 2/2005 | Creary |
| 2005/0101448 | A1 | 5/2005 | He et al. |
| 2005/0183759 | A1 | 8/2005 | Wolfe |
| 2005/0250624 | A1 | 11/2005 | Yu |
| 2006/0052728 | A1 | 3/2006 | Kerrigan et al. |
| 2006/0062413 | A1 | 3/2006 | Wehrell |
| 2006/0079378 | A1 | 4/2006 | Ader |
| 2006/0240956 | A1 | 10/2006 | Piane |
| 2007/0016116 | A1 | 1/2007 | Reinkensmeyer et al. |
| 2007/0219069 | A1 | 9/2007 | Nativ |
| 2007/0272484 | A1 | 11/2007 | Helms |
| 2008/0017227 | A1 | 1/2008 | Ward |
| 2008/0070757 | A1 | 3/2008 | Albert |
| 2008/0282442 | A1 | 11/2008 | Bauvois |
| 2008/0300118 | A1 | 12/2008 | Wehrell |
| 2008/0306412 | A1 | 12/2008 | Nieminen et al. |
| 2009/0014004 | A1 | 1/2009 | Whalen et al. |
| 2009/0082700 | A1 | 3/2009 | Whalen et al. |
| 2009/0221404 | A1 | 9/2009 | Dorogusker et al. |
| 2009/0236176 | A1 | 9/2009 | Sheu et al. |
| 2009/0255531 | A1 | 10/2009 | Johnson et al. |
| 2010/0000547 | A1 | 1/2010 | Johnson et al. |
| 2010/0006737 | A1 | 1/2010 | Colombo et al. |
| 2010/0139057 | A1 | 6/2010 | Soderberg et al. |
| 2010/0170546 | A1 | 7/2010 | Popovic et al. |
| 2010/0197462 | A1 | 8/2010 | Piane |
| 2010/0197465 | A1 | 8/2010 | Stevenson |
| 2010/0248903 | A1 | 9/2010 | Cardile |
| 2010/0279837 | A1 | 11/2010 | Stengel |
| 2011/0098157 | A1 | 4/2011 | Whalen et al. |
| 2011/0098615 | A1 | 4/2011 | Whalen et al. |
| 2011/0219899 | A1 | 9/2011 | Dize et al. |
| 2012/0004581 | A1 | 1/2012 | Dinon |
| 2012/0042917 | A1 | 2/2012 | Workman et al. |
| 2012/0238921 | A1 | 9/2012 | Kuehne et al. |
| 2012/0277643 | A1 | 11/2012 | Whalen et al. |
| 2013/0324893 | A1 | 12/2013 | Kuehne et al. |
| 2014/0113775 | A1 | 4/2014 | Egan |
| 2015/0011917 | A1 | 1/2015 | Whalen et al. |
| 2015/0379239 | A1 | 12/2015 | Basta et al. |
| 2016/0000155 | A1 | 1/2016 | Marecek et al. |
| 2016/0001119 | A1 | 1/2016 | Jue et al. |
| 2016/0007885 | A1 | 1/2016 | Basta et al. |
| 2016/0008650 | A1 | 1/2016 | Jue et al. |
| 2016/0073704 | A1 | 3/2016 | Basta et al. |
| 2017/0128769 | A1 | 5/2017 | Long et al. |

FOREIGN PATENT DOCUMENTS

| | | | |
|---|---|---|---|
| DE | 29508818 | U1 | 11/1995 |
| DE | 19502801 | C2 | 10/1996 |
| DE | 20004959 | U1 | 6/2000 |
| DE | 20313772 | U1 | 12/2003 |
| EP | 0917890 | A2 | 5/1999 |
| EP | 2512758 | A2 | 10/2012 |
| EP | 2532927 | A2 | 12/2012 |
| ES | 2151390 | A1 | 12/2000 |
| FR | 1180387 | A1 | 6/1959 |
| FR | 2755865 | A1 | 5/1998 |
| FR | 2831065 | A1 | 4/2003 |
| FR | 2846888 | A1 | 5/2004 |
| FR | 2939050 | A1 | 6/2010 |
| GB | 2314512 | A | 1/1998 |
| JP | 05-500760 | | 2/1993 |
| JP | 1022334 | | 10/1998 |
| JP | 11-113988 | A | 4/1999 |
| JP | 2001-112886 | | 4/2001 |
| JP | 2002-28202 | A | 1/2002 |
| JP | 2004-073445 | A | 3/2004 |
| JP | 2004329365 | A | 11/2004 |
| JP | 2004353439 | A | 12/2004 |
| JP | 1395000 | | 8/2010 |
| JP | 1421980 | | 8/2011 |
| JP | 2012-214936 | A | 11/2012 |
| KR | 20030086404 | | 11/2003 |
| TW | M339250 | U | 9/2008 |
| WO | WO96/31256 | A1 | 10/1996 |
| WO | WO99/30271 | A1 | 6/1999 |
| WO | WO01/24900 | A1 | 4/2001 |
| WO | WO02/098516 | A1 | 12/2002 |
| WO | WO2004/080365 | A1 | 9/2004 |
| WO | WO2004/103176 | A1 | 12/2004 |
| WO | WO2007/038888 | A1 | 4/2007 |
| WO | WO2007/115565 | A2 | 10/2007 |
| WO | WO2008/030366 | A2 | 3/2008 |
| WO | WO2008/058567 | A1 | 5/2008 |
| WO | WO2009/151630 | A1 | 12/2009 |
| WO | WO2011/089632 | A1 | 7/2011 |
| WO | WO2011/112898 | A1 | 9/2011 |
| WO | WO2012/107700 | A2 | 8/2012 |

(56) References Cited

FOREIGN PATENT DOCUMENTS

| | | | |
|---|---|---|---|
| WO | WO2012/118143 | A1 | 9/2012 |
| WO | WO2013/019956 | A1 | 2/2013 |
| WO | WO2013/021709 | A1 | 2/2013 |
| WO | WO2014/138228 | A1 | 9/2014 |
| WO | WO2015/195983 | A1 | 12/2015 |

OTHER PUBLICATIONS

Burgess et al.; Overground walking speed changes when subjected to body weight support conditions for nonimpaired and post stroke individuals; J NeuroEng Rehabil.; 7(6); 10 pgs.; Feb. 2010.

Capó-Lugo et al.; Maximum walking speeds obtained using treadmill and overground robot system in persons with post-stroke hemiplegia; J NeuroEng Rehabil.; 9(80); 14 pgs.; Oct. 2012.

Díaz et al.; Lower-Limb Robotic Rehabilitation: Literature Review and Challenges; Hindawi Pub. Corp.; Journal of Robotics; vol. 2011; Art. ID 759764; 11 pgs.; (accepted for publn.) Sep. 2011.

Hamilton; Low-Tech Alternative to AlterG on Market; Runner's World; 2 pgs.; Aug. 16, 2012; (printed from internet: http://www.runnersworld.com/elite-runners/low-tech-alternative-alterg-market).

Kawai et al.; Rehabilitation apparatus for treadmill walking using lower body positive pressue (Japanese & English abstracts); Aerospace and Environmental Medicine; vol. 44; No. 4; (year of pub. sufficiently earlier than effective filing date and any foreign priority date) 2007.

Lillegard, R.; Running on air (retrieved Aug. 10, 2016 from the internet: http://www.lightspeedrunningandrehabilitation.com/in-the-news/running-on-air/#more-89); Duluth Superior Magazine; 3 pgs.; Jul. 2, 2012.

Pates, K.; Duluth physical therapist develops running aid; (retrieved Aug. 10, 2016 from the internet: http://www.lightspeedrunningandrehabilitation.com/in-the-news/duluth-physical-therapist-develops-running-aid/#more-92); Duluth News Tribune; 3 pgs.; Jul. 25, 2012.

Patton et al.; KineAssist: Design and development of a robotic overground gait and balance therapy device; Top Stroke Rebabil.; 15(2); pp. 131-139; Mar.-Apr. 2008.

Whalen et al.; Design U.S. Appl. No. 29/337,097 entitled "Adjustable Positive Pressure Support System," filed May 14, 2009.

Whalen et al.; U.S. Appl. No. 15/046,358 entitled "System, method and apparatus for applying air pressure on a portion of the body of an individual," filed Feb. 17, 2016.

Whalen et al.; U.S. Appl. No. 15/143,351 entitled "Systems, methods and apparatus for differential air pressure devices," filed Apr. 29, 2016.

* cited by examiner

MONOCOLUMN UNWEIGHTING SYSTEMS

CROSS-REFERENCE TO RELATED APPLICATIONS

This application claims priority to U.S. Provisional Application No. 61/773,037, titled "Monocolumn Unweighting Systems," and filed Mar. 5, 2013, the entirety of which is incorporated by reference herein.

INCORPORATION BY REFERENCE

All publications and patent applications mentioned in this specification are herein incorporated by reference to the same extent as if each individual publication or patent application was specifically and individually indicated to be incorporated by reference.

FIELD

Described herein are various embodiments of unweighting systems for unweighting a user and methods of using such systems.

BACKGROUND

Methods of counteracting gravitational forces on the human body have been devised for therapeutic applications as well as physical training. Rehabilitation from orthopedic injuries or neurological conditions often benefits from precision unweighting (i.e. partial weight bearing) therapy.

One way to unweight is to use a frame with elastic cords. Such existing systems are simple affairs, often relying on stretched bungee cords to provide the necessary unweighting forces. Use of bungee cords causes unweighting force to be poorly controlled, varying from cord to cord, over time, and with usage. In addition to a lack of repeatability, the inability to display unweighting force further prevents users from comparing current workouts with previous workouts. Furthermore, inability to easily adjust unweighting force requires user to dismount from the system to change settings. Frames are typically designed to be entered from the side, making close packing of systems over treadmills in a fitness club environment impractical. Also, these systems must typically be manually adjusted for differing user heights, complicating the usage process.

Another way to counteract the effects of gravity is to suspend a person using a body harness in conjunction with inelastic cords or straps to reduce ground impact forces. However, currently available harness systems are often uncomfortable and require suspension devices or systems that lift the user from above the user's torso. Such systems distribute weight unnaturally and uncomfortably on the user's body. The weight distribution can interfere with natural movements due to issues such as penduluming, quickly tightening/loosening, tilting the body, etc. In some cases, prolonged use with these harness suspension systems can result in injuries that range from mild skin abrasion or contusions or musculo-skeletal injury. In attempting to address the discomfort and limited mobility induced by such inelastic systems, some harness systems employ the use of bungee or elastic tensioning cords that need to be hooked and unhooked or manually stretched to adjust the degree of unweighting experienced. Such adjustment is cumbersome, inconvenient, and dangerous as the user may lose control of the tensioned cords during adjustment, causing the cords to strike the user with a substantial amount of force. All such overhead cord system do not constrain users from side-to-side or fore-and-aft motion, requiring users to focus on maintaining their position in space.

Other systems for unweighting a user have been developed. In one such system, a portion of a user's body is submerged into a water-based system to thereby permit buoyancy provided by the water offset gravity. However, both the upward supporting force and the effective point where the force is applied, provided by such water-based systems is dependent on the depth to which the user's body is submerged below the water surface, making unweighting force adjustability and natural weight distribution difficult to achieve, at best. Moreover, the viscous drag of the water may substantially alter the muscle activation patterns of the user. Users with open wounds, casts, splints, or other encumbrances are also not able to use water-based therapy.

Differential Air Pressure (DAP) systems have been developed to use air pressure in, for example, a sealed chamber to simulate a low gravity effect and support a patient at his center of gravity without the discomfort of harness systems or the inconvenience of water-based therapies. DAP systems generally utilize a chamber for applying differential air pressure to a portion of a user's body. While useful in training a wide variety of patient types, DAP systems have control systems to monitor and/or maintain pressure levels, pressure enclosures and the like to varying degrees based on the electrical and mechanical designs and complexity of the system, all of which add to the cost of such systems.

In view of the above shortcomings and complications in the existing unweighting systems, there remains a need for simple yet effective unweighting systems. In particular, for an average user who may not have a medical condition warranting physical therapy or medical supervision, there is also an additional need for unweighting systems suited to gym or home use. As such, a need exists for an unweighting system that allows users economical and effective alternatives to the current techniques available.

An important characteristic of unweighting systems intended for exercise or gait training is a low vertical spring rate, where the user's vertical position has minimal influence on the unweighting force applied to the user. This is significant because as a user walks or runs, their vertical displacement during different phases of the gait cycle can vary by ± two inches or more. A low vertical spring rate ensures that the unweighting force is nearly equal during all phases of the gait cycle. While fluid based systems such as DAP or pool-based therapies have inherently low vertical spring rates, the same is not true for most mechanical unweighting systems. The need for a low spring rate often requires the use of very long spring elements such as bungee cords, making these systems less than compact and/or unable to exert more than minimal unweighting forces. A further need is for a compact unweighting system with a low vertical spring rate.

SUMMARY

Embodiments described herein provide unweighting systems that are easily accessible by both healthy and mobility impaired users. Advantageously, users can use the described systems with or without the aid of a medical professional. Additionally, embodiments described herein address the need for a cost-effective system that can be used for exercise alone or, additionally or alternatively, in conjunction with a separate exercise device where the unweighting system can be purchased separately and optionally attached to the separate exercise device in a user's home or gym.

In general, in one embodiment, an unweighting system includes a frame having a base and a vertical bar extending therefrom. The base is configured to connect to or at least partially encircle an exercise device. A height adjustable cantilevered arm assembly is coupled to the vertical bar at a fulcrum, and the cantilevered arm assembly is configured to receive and couple to the user. A resilient member is coupled to the cantilevered arm assembly and configured to unload a portion of the user's weight while the user is coupled to the cantilevered arm assembly and exercises on the exercise device.

Any of these embodiments can include one or more of the following features. The vertical bar can be configured so as to extend substantially in a sagittal plane of the user's body when the user is coupled to the cantilevered arm assembly. The vertical bar can be configured to extend in front of the user when the user is coupled to the cantilevered arm assembly and exercises on the exercise device. The resilient member can be a coiled spring. A longitudinal axis of the resilient member can extend substantially parallel to the vertical bar. The vertical bar and the cantilevered arm assembly can be configured to form an angle of approximately 90° when the arm assembly is coupled with the user. The cantilevered arm assembly can be configured to receive and couple to the user below the user's torso. The cantilevered arm assembly can be adapted to receive and couple proximate to the user's hips. The resilient member can be configured to compress to unload the portion of the user's weight. A length of the resilient member can be variable to adjust a degree of unloading experienced by the user. The resilient member can include a lead screw and nut connected thereto. The lead screw can be configured to rotate relative to the nut to vary the length of the resilient member. The unweighting system can further include a knob attached to the lead screw that can be configured to be manually turned to vary the length of the resilient member. The unweighting system can further include a motor configured to control the length of the resilient member. The fulcrum can include a pivot point such that the cantilevered arm assembly can pivot vertically about the fulcrum to track vertical movement of the user while the user exercises on the exercise device. The fulcrum can be configured to move vertically along the vertical bar to adjust the height of the cantilevered arm assembly. The cantilevered arm assembly can include an attachment mechanism configured to attach to an article of clothing of the user. The attachment mechanism can include a velcro, a lock, a latch, a cord, a hook, or a rope. The resilient member can be positioned between the fulcrum and a point of attachment of the cantilevered arm assembly to the user. The arm assembly can include two arm portions extending from a central beam at a pivoting joint, the central beam coupled to the fulcrum. A distance between the two arm portions can be adjustable at the pivotable joint to adapt to a size of the user. The pivotable joint can include a plurality of struts attached to the arm portions that can connect together by one or more pin. An angle between the struts can be adjustable at the pin. The exercise device can be a treadmill. The height adjustable cantilevered arm assembly can be configured to provide the only coupling point for the user during unloading.

In general, in one embodiment, a method of unweighting a user during exercise includes: (1) coupling a user to a cantilevered arm assembly of an unweighting system, where the unweighting system includes a resilient member; (2) compressing the resilient member to provide a force sufficient to unload a portion of the user's weight; and (3) allowing the user to exercise on an exercise device while the portion of the user's weight is unloaded with the resilient member.

Any of these embodiments can include one or more of the following features. The method can further include tracking movement of the user's hips as the user exercises by vertically pivoting the arm assembly about a fulcrum. The method can further include shortening a length of the resilient member to unload an additional portion of the user's weight. The method can further include adjusting the width of the arm assembly such that the user fits within the arm assembly. The method can further include monitoring an amount of the user's weight unloaded by the system. The method can further include adjusting a height of the arm assembly to fit the user. Adjusting a height of the arm assembly to fit the user can include adjusting a height of the arm assembly to fit proximate to the user's hips. Coupling a user to a cantilevered arm assembly of an unweighting system can include coupling the hips of the user to the cantilevered arm assembly. Allowing the user to exercise on an exercise device while the portion of the user's weight is unloaded with the resilient member can include allowing the user to walk or run on a treadmill while the portion of the user's weight is unloaded. Coupling a user to a cantilevered arm assembly of an unweighting system can include coupling the user such that the user faces a vertical bar attached to the cantilevered arm assembly.

In general, in one embodiment, a method of unloading a portion of weight of a user during exercise includes: (1) stepping onto a treadmill towards a cantilevered arm assembly; (2) adjusting a height of the cantilevered arm assembly so as to align the cantilevered arm assembly with the user's hips; (3) attaching the cantilevered arm assembly to the hips to unload a portion of the user's body weight; and (4) exercising on the treadmill while the portion of body weight is unloaded.

In general, in one embodiment, an unweighting system for adjustably unloading a user's weight includes a height adjustable fulcrum. A frame includes a base and a vertical bar adapted to be coupled to the height adjustable fulcrum. An arm assembly is coupled to the height adjustable fulcrum, and the arm assembly is adapted to receive and couple to the user. The adjustable unweighting assembly further includes a movable resilient member attached to the height adjustable arm.

Any of these embodiments can include one or more of the following features. The adjustable unweighting assembly can further include a lead screw and a lead nut. The adjustable unweighting assembly can further include a load cell. The adjustable unweighting assembly can be configured to unload a portion of the user's weight by compressing the resilient member. The adjustable unweighting assembly can be configured to vary the resilient member length. An amount of force provided by the resilient member can be adjusted by changing the height of the arm assembly. The height adjustable fulcrum can be adapted to move vertically along the vertical bar. The arm assembly can be adapted to pivot about the fulcrum. The resilient member can be adapted to support the arm assembly. The resilient member can be located at a distance to the fulcrum sufficient to result in relatively constant lifting of the user. The resilient member length can be adjustable. The resilient member length can be adjustable to vary a lifting force experienced by the user. The system can further include an exercise device. The system can further include a motorized actuator adapted to compress the resilient member.

In general, in one embodiment, a method of unweighting a user during exercise includes: (1) coupling a user to an arm assembly of an unweighting system, where the unweighting system includes a resilient member; (2) compressing the resilient member to provide a force sufficient to unload a portion of the user's weight; and (3) tracking the movement of the user's hips during the user's movement by vertically pivoting the arm assembly about a height adjustable fulcrum.

Any of these embodiments can include one or more of the following features. The method can further include shortening the length of the resilient member to increase the portion of the user's weight unloaded. The method can further include applying a relatively constant lifting force to the user. The method can further include adjusting the width of the arm assembly. The method can further include turning a lead screw to adjust the length of the resilient member. The method can further include measuring the amount of the user's weight unloaded by the system.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

As described above, there is a need for an unweighting system that allows a user to comfortably and easily adjust the user's unweighted load without help from a medical professional. Existing unweighting systems do not address this need, as these systems are designed either for a fixed amount of unweighting during usage (i.e. non-adjustable unweighting) or adjustment by a medical professional such as a physical therapist. In general, the unweighting system described here includes a monocolumn having a cantilever and a resilient member attached thereto.

Figure 1:
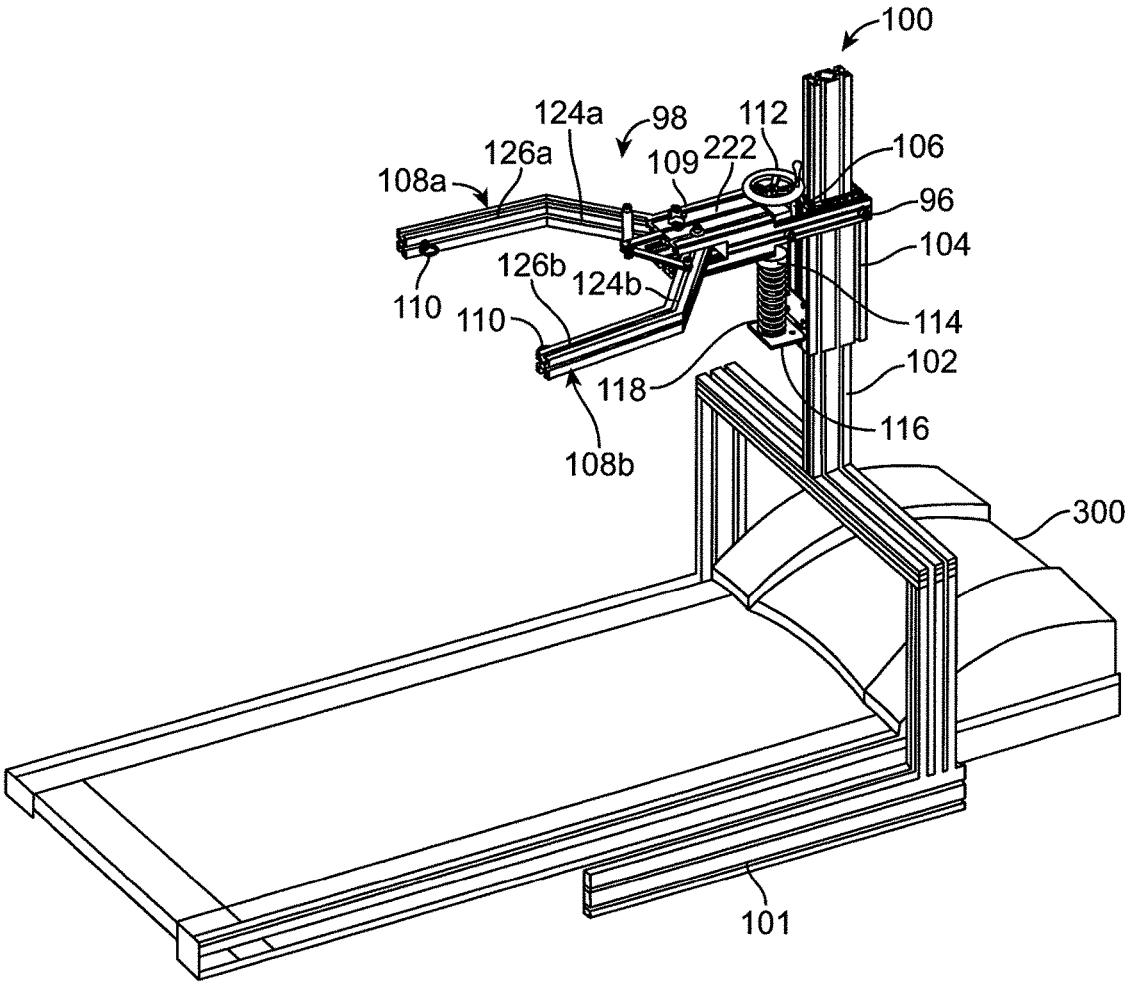
FIG. 1 shows a monocolumn unweighting system.

FIG. 1 shows an overview of an exemplary spring-based unweighting system 100. As shown, the unweighting system 100 includes a frame with a base 101. The base 101 is connected to a monocolumn or vertical bar 102. A height adjustable fulcrum 104 is movably attached to the vertical bar 102. The vertical bar 102 may include slots, stays, or stops that meet with corresponding structures of the height adjustable fulcrum 104 to allow vertical movement along and attachment, to the vertical bar 102. Additionally, the unweighting system 100 according to some embodiments may be attached to, at least partially encircling, or positioned around exercise equipment, such as a treadmill 300. Although shown with a treadmill, it can be appreciated that the exercise device used can be any exercise device such as an elliptical or bike etc. Additionally, it can be appreciated that the unweighting system 100 need not be used with an exercise device. The unweighting system 100 may be used, for example, with an exercise platform for jumping or aerobic exercising.

Advantageously, the unweighting system 100 shown in FIG. 1 provides an adjustable arm assembly 98 to accommodate different users of varying heights and/or widths. The arm assembly 98 can form a yoke configured to extend from the vertical bar 102 and then splay out to surround the user. In some embodiments, the arm assembly 98 is y-shaped (e.g. including a central beam 222 and two arms 108*a,b*) or v-shaped (with the apex extending from the vertical bar 102). Further, in some embodiments, the arms 108*a,b* include bends therein while in other embodiments, the arms 108*a,b* extend straight out. In embodiments with a bend, for example, the arms 108*a,b* can have first portions 124*a,b* that angle away from the central beam 222 or the vertical bar 102 and second portions 126*a,b* that extend substantially parallel to the sides of the base 101 and/or the treadmill 300 (see FIG. 1).

Figure 3A:
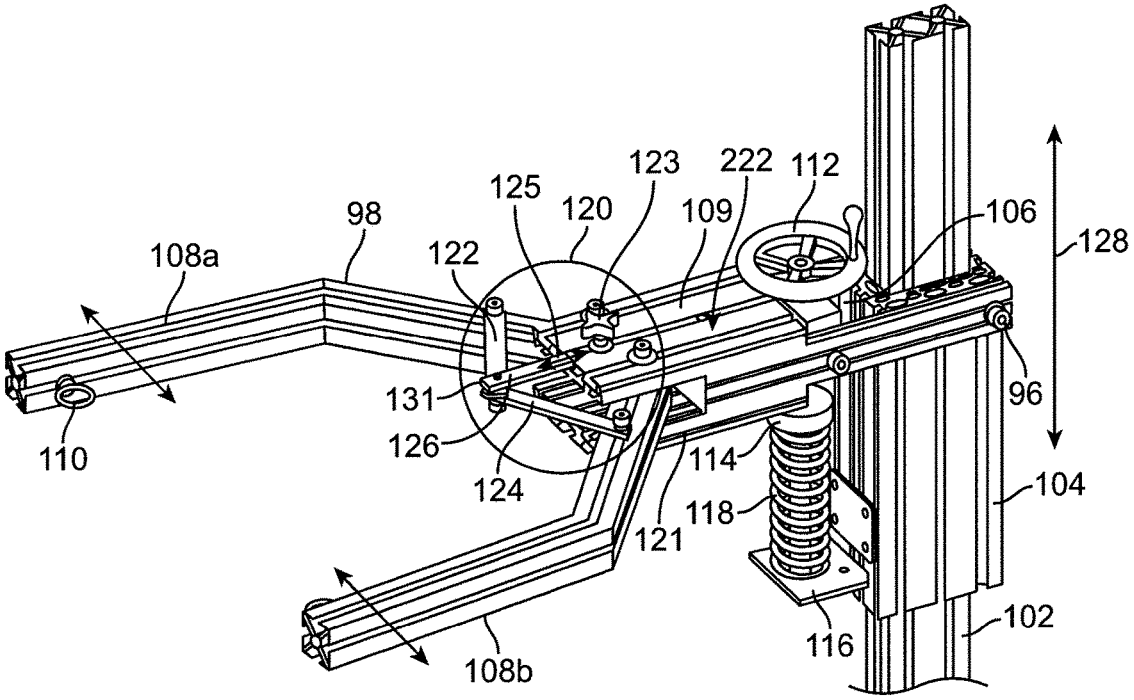
FIGS. 3A-C shows the arm assembly and components of the unweighting system in FIG. 1.
Figure 3B:
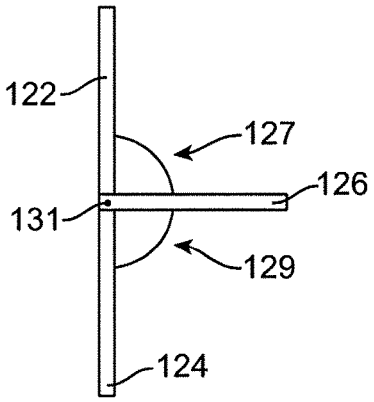
Figure 3C:
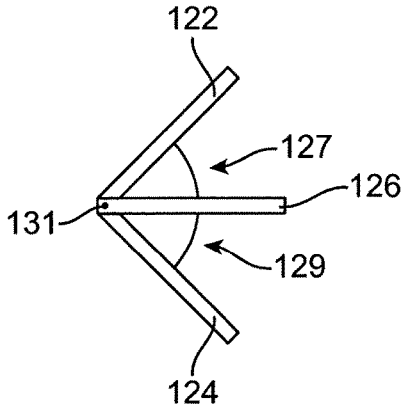

The arms 108*a,b* can be movable so as to adjust the distance therebetween. For example, the arm assembly 98 may include a user size adjustment system 120 (see FIG. 3A) for adjusting the width between the arms 108*a-b* to accommodate users of different size or widths. The user size adjustment system 120 may comprise a plurality of ribs or struts 122, 124, 126. The struts 122, 124, 126 can be connected together at a pivot point 131. Further, the first strut 122 can be attached to first arm 108*a*, the second strut 124 can be attached to the second (or opposing) arm 108*b*, and the third strut 126 can be connected to the central beam 222 (or directly to the vertical bar 102 in other embodiments). The distance between the arms 108*a-b* is varied by moving the struts 122, 124, 126 relative to one another at the pivot point 131 to change the angle formed between the struts 122, 124, 126. FIGS. 3B and 3C show examples of the strut angles 127 and 129. FIG. 3B shows 90 degree angles 127 and 129 formed by strut 122, 124, 126 about the pivot point 131. FIG. 3C shows acute angles less than 90 degrees formed by the struts 122, 124, 125 about the pivot point 131. The distance between the arms 108*a-b* can be increased by increasing the angle between the struts 122, 124, 126. Likewise, the distance between the arms 108*a-b* is decreased by decreasing the angle between the struts 122, 124, 126.

In some embodiments, the middle strut 126 can be moved towards and away from the central beam 222 (as show by the arrow 125 in FIG. 3A) in order to accommodate the movement of the struts 122, 124 and/or arms 108*a,b*. As shown in FIG. 3A, the strut 126 is partially housed between a top plate 109 and a bottom plate 121 of the central beam 222. The strut 126 can slide into and out of the space between the plates 109, 121. That is, sliding the strut 126 inward into the space between plates 109, 121 will move the pivot point 131 toward the central beam 222 and thereby increase the angle between the struts 122, 124, 126. This will, in turn, also increase the distance between the arms 108*a-b*. Likewise, sliding the strut away from the central beam 222 will move the pivot point 131 away from the central beam 222, thereby decreasing the angle between the struts 122, 124, 125 and decreasing the distance between the arms 108*a,b*.

In some embodiments, the user size adjustment system 120 includes a screw or knob 123 (see FIG. 3A) configured to control and/or fix the position of the strut 126 (and thus the position of the struts 122, 124 and the arms 108*a,b*). The knob or screw 123 may be loosened to allow the connecting member 126 to move relative to plates 109, 121 and tightened to fix the position of the connecting member 126. In some embodiments, the width of the arms 108*a-b* is fixed once the connecting member 126 is locked in position by the screw 123. Although shown as three struts, it is contemplated that any number of struts or connecting members may be employed to provide adjustability to the distance between the two arms 108*a,b*.

As described, the distance between the arms 108*a-b* can be set to accommodate a user's size. For example, the distance between the arms 108*a-b* (such as between second portions 126*a,b* shown in FIG. 1) can be set to be between about 10 inches to about 19 inches to accommodate typical user waist sizes. In some embodiments, the distance between the arms is set to be about 15 inches. In other embodiments, the distance between the arms is between about 12-18 inches.

Figure 8A:
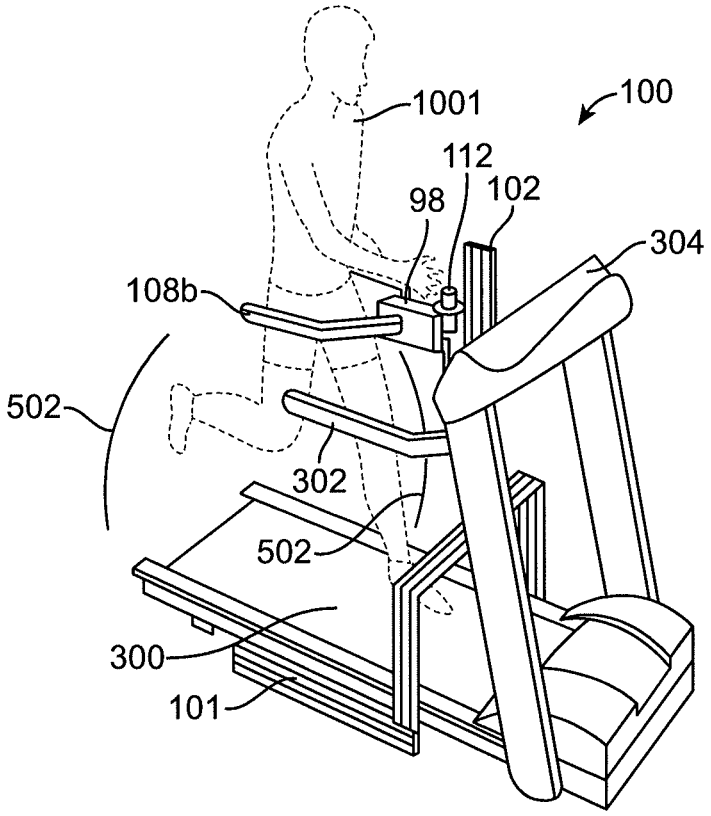
FIGS. 8A-8D shows a running envelope provided by a monocolumn unweighting system.

Referring to FIG. 1, the arm assembly 98 can be attached to the height adjustable fulcrum 104 and/or the vertical bar 102. The vertical bar 102 can extend substantially through the sagittal plane of the runner when the runner is on the treadmill 300 and/or can extend substantially through a midpoint of the front of the treadmill 300 (see FIGS. 8A-8B).

Figure 2:
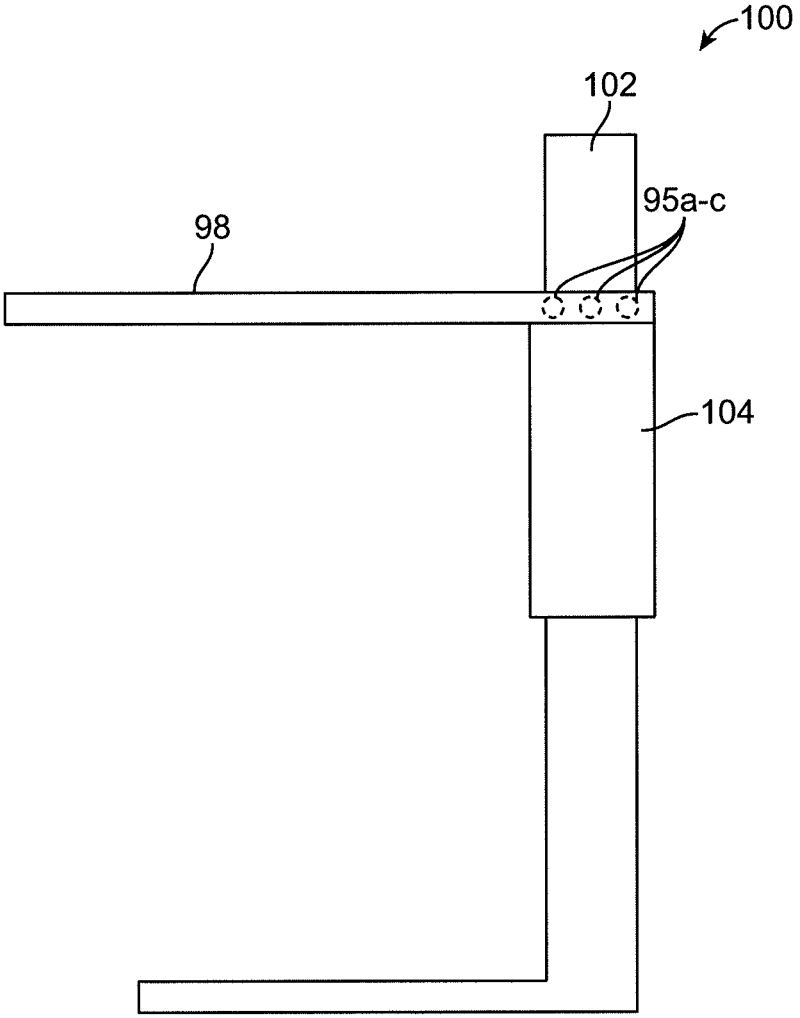
FIG. 2 shows a side view of different locations for the pivot point on the height adjustable fulcrum.

In some embodiments, the arm assembly 98 includes an opening or slot 106 allowing the vertical bar 102 (and fulcrum 104) to traverse through a cross-section of the arm assembly 98. In some embodiments, the arm assembly 98 is attached to the height adjustable fulcrum 104 by an attachment means, such as a pin 96 (see FIG. 4) while the fulcrum 104 is attached to the vertical bar 102. The pin 96 is configured to allow the arm assembly 98 to pivot about the height adjustable fulcrum 104 and/or the vertical bar 102. The pin 96 may attach the arm assembly 98 anywhere on the height adjustable fulcrum 104 where there is overlap between the two structures. For example, FIG. 2 shows three locations 95*a-c* where a pin or other attachment component can be used to fix the arm assembly 98 to the height adjustable fulcrum 104.

The attachment (e.g., pin 96) between the arm assembly 98 and the height adjustable fulcrum and/or the vertical bar 102 may be designed to provide the user with a range of motion in the upward and downward direction. That is, the arm assembly 98 can pivot at the pin 96 to track the movement of the user's hip during motion when the user is attached to the arm assembly 98. Generally, a user's hip moves approximately four inches vertically when running or walking. The pivot point about the pin 96 can advantageously accommodate this vertical motion. For example, the arm assembly 98 can pivot from a neutral horizontal position to an angled upward or downward position to track the user's hip position during user movement to provide the user with a natural running experience.

The arm assembly 98 can be adjustable in a vertical direction (see arrow 128 in FIG. 4) to accommodate users of different heights. For example, the height adjustable fulcrum 104 (with the arm assembly 98 attached thereto) can move up or down the vertical bar 102, such as via a roller and track mechanism or a telescoping mechanism. In other embodiments, the arm assembly 98 can move up or down the height adjustable fulcrum, such as through a spring-loaded retractable pin in the arm assembly 98 that inserts into one of a series of holes in the height adjustable fulcrum. In some embodiments, the height adjustment mechanism can be motorized with an electric motor or a hydraulic lift. The movement of the arm assembly 98 relative to the vertical bar 102 can advantageously allow the arm assembly 98 to be positioned properly on the user, such as below the torso (e.g. proximate to the user's hips). In some embodiments, the angle between the arm assembly 98 and the vertical bar 102 can be approximately 90 degrees when the user is attached to the arms 108*a,b* and in a resting or standing position (i.e., before running or walking).

The unweighting system 100 may further include a resilient member or spring 118 to provide unloading of a user attached to the arm assembly 98. Referring to FIG. 1, the spring 118 of unweighting system 100 can be positioned below the central beam 222 of the arm assembly 98 proximate to the vertical bar 102. Further, in some embodiments, the spring 118 can be positioned between the fulcrum 104 and the arms 108*a,b*. The spring 118 can be a coiled spring with the longitudinal axis of the resilient member extending substantially parallel to the vertical bar 102 and/or substantially perpendicular to the arm assembly 98.

Figure 4:
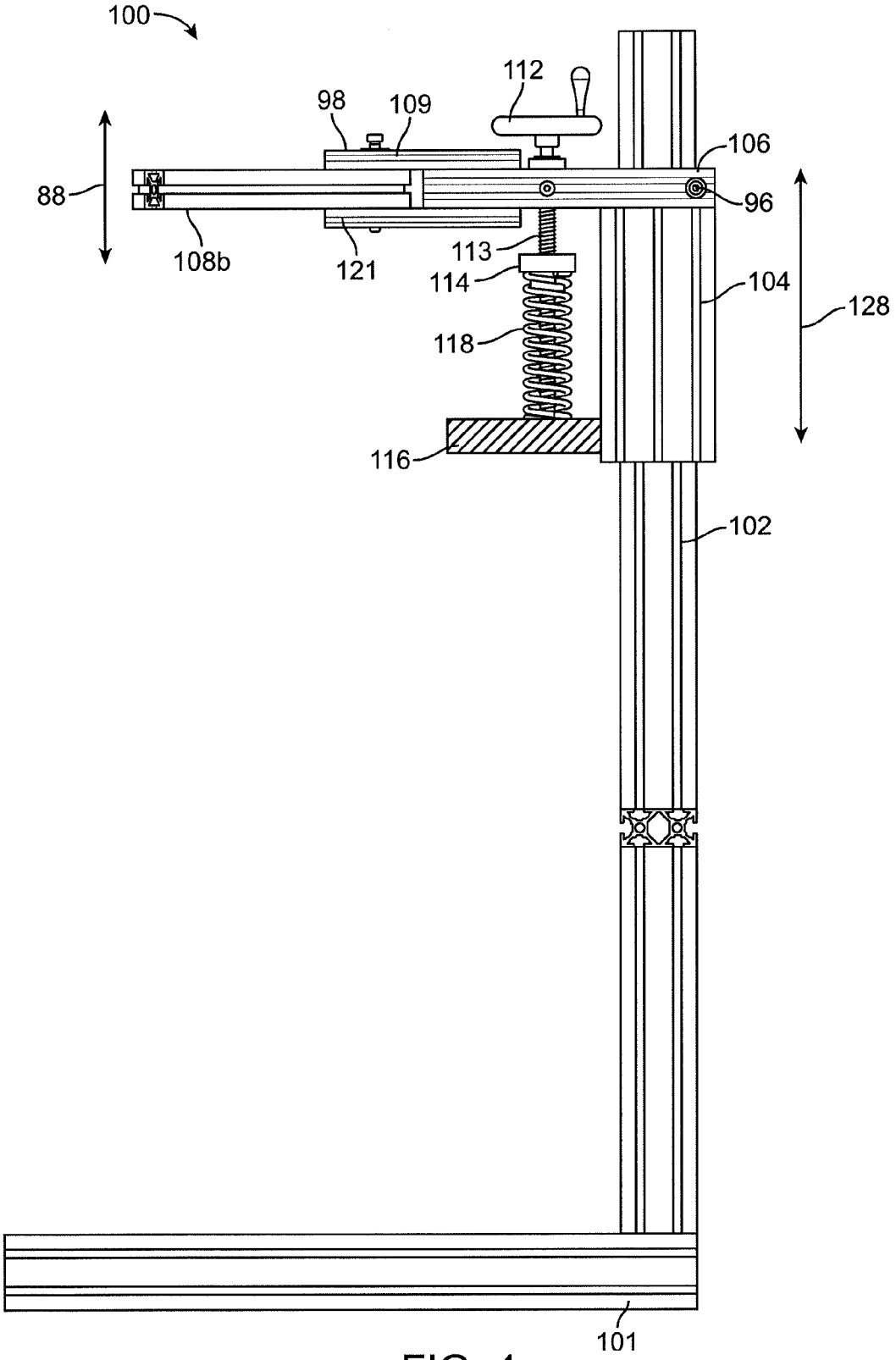
FIG. 4 shows a side view of a monocolumn unweighting system.
Figure 6A:
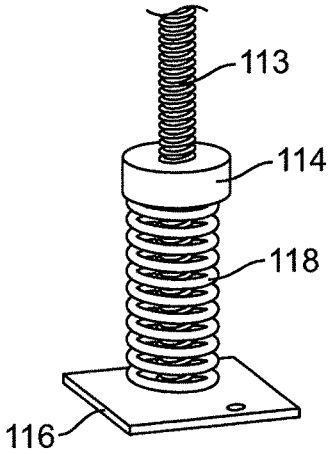
FIGS. 6A-6C show a mechanisms for varying a spring length.
Figure 6B:
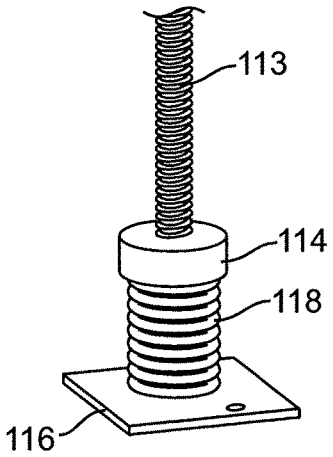
Figure 6C:
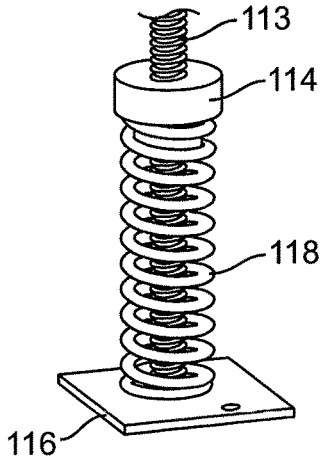

Further, in some embodiments, the spring force imparted by the spring 118 can be modified by adjusting the spring length. Thus, referring to FIGS. 1 and 4, in some embodiments (as shown in FIGS. 1 and 4), the spring 118 can be housed between a plate 116 and a lead nut 114. A lead screw 113 can be positioned within the coils of the spring 118. The lead screw 113 can be axially restrained within the arm assembly 98 but be free to rotate. FIGS. 6A, 6B, and 6C illustrate the spring compression caused by rotation of the lead screw 113. FIG. 6A shows that when the lead screw 113 is turned to move the lead nut 114 down the length of the lead screw 113, the lead nut 114 contacts an end of the spring 118. As shown in FIG. 6B, as the lead nut 114 continues to move down the length of the lead screw 113, the nut 114 may compress the spring 118 to shorten the spring 118 length, which results in an increase to the force exerted by the spring 118. Similarly, when the lead screw 113 is turned to upwardly move the lead nut 114, the lead nut 114 may allow the spring 118 to lengthen and expand and reduce the amount of force exerted by the spring 118, which is shown in FIG. 6C. In some embodiments (shown in FIGS. 1 and 4), a knob 112 can be attached to an end of the lead screw 113. By turning the knob 112, the lead screw 113 rotates and moves the lead nut 114 upwards or downwards along the length of the lead screw 113, thereby compressing or releasing the spring 118. In other embodiments, a motor may be used to rotate the lead screw 113 to move the lead nut 114 along the length of the lead screw 113 to compress or extend the spring 118.

Figure 17:
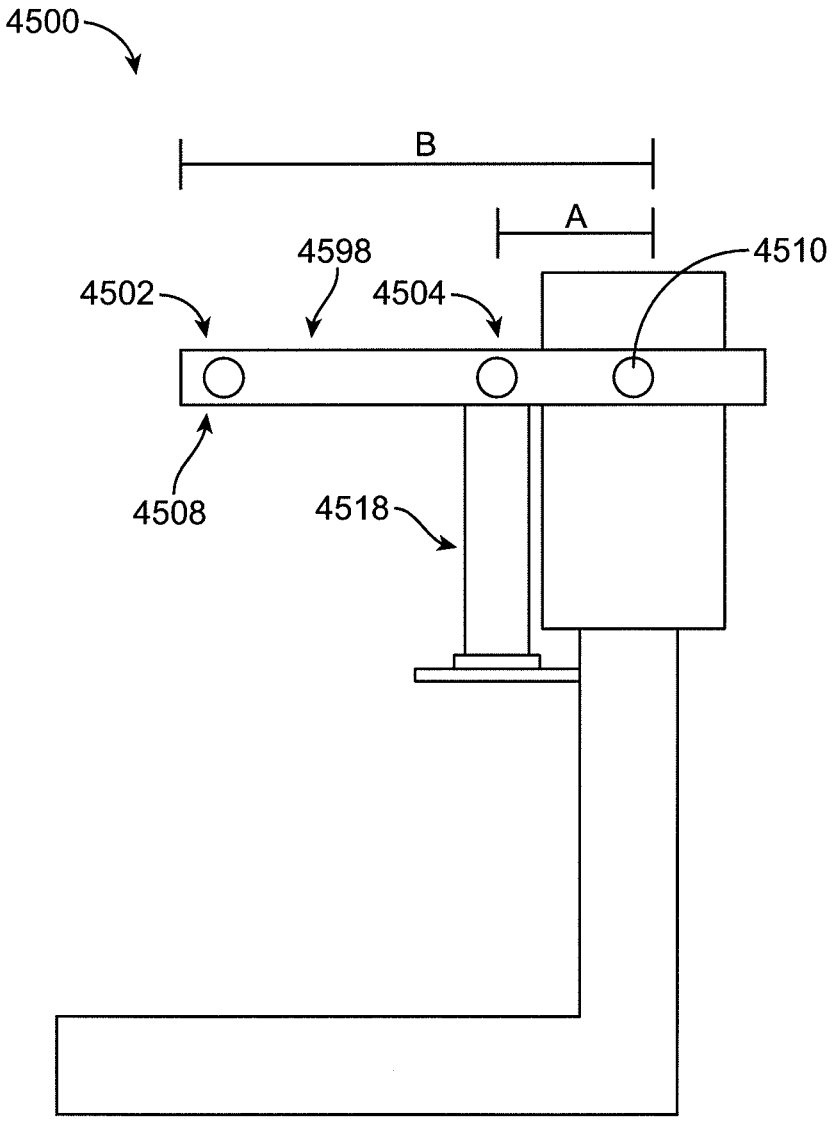
FIG. 17 shows varying spring rates along the length of the arm assembly.

Moreover, the unweighting system 100 may include a first spring rate at a first position along the arm assembly and a second rate at a second position along the arm assembly. For example, FIG. 17 shows an unweighting system 4500 with an arm assembly 4598 and a spring 4518. Further, FIG. 17 shows two positions 4502 and 4504 along the arm assembly 4598. The position 4504 is the position of the spring 4506 relative to the arm assembly 4598 while the position 4502 is the attachment point for coupling a user to the arm assembly 4598. The spring rate at position 4504 is a first spring rate and the effective spring rate at position 4502 is a second spring rate 4508. In some embodiments, the second spring rate at 4502 is the first spring rate (at 4504) proportionally reduced by the relative distance between the two positions from a pivot point 4510. For example, if the rate of the spring 4506 is 15 lbs/inch at first position 4504 and the second position 4502 is three times further from the pivot point 4510 compared to the first position 4504, then second spring rate 4508 at the second position 4502 will be one-third of the first spring rate, or 5 lbs/inch. When the spring 4506 is compressed (or shortened) two inches, the effective load unweighted at the second position 4502, where the user is attached, is 10 lbs. More generically, where "B" is the distance between the second position (e.g. attachment to user on the arm assembly) and the pivot point and "A" is the distance between the first position (spring attachment) and the pivot point, then the second spring rate is related to the first spring rate by the following: first spring rate×(B/A). In some embodiments, the rate of the spring at the spring attachment position is about 117 lbs/inch. In other embodiments, the spring rate at the user attachment point is between about 2-5 lbs/inch.

In some embodiments, the separation distance from the arm assembly 98 to the plate 116 may be adjusted based on the size or length of the spring 118 and/or to change a size or length of the spring 118.

Referring again to the unweighting system 100 in FIG. 1, the system 100 also includes an attachment element 110 for coupling a user to the unweighting system 100. The attachment element 110 may be used to attach an article of clothing such as shorts or a harness to the arms 108*a-b*. In some embodiments, the attachment element 110 is a lock, such as a carabineer or spring lock, that secures the shorts to the arms. Any attachment means, such as mechanical connectors including mating attachments, Velcro, locks, latches, cords, hooks, rope, etc. can be used. Moreover, any unweighting garment may be used to attach to the unweighting system 100, such as those described in the PCT Patent Application No. _____ titled UNWEIGHTING GARMENTS, and filed Mar. 5, 2014, the entire contents of which are incorporated by reference.

The unweighting systems described herein can include an adequate exercise envelope within and therearound to accommodate the movement of the user's limbs while using the unweighting system during exercise. For example, FIGS. 8A-8D show the unweighting system 100 of FIG. 1 with a treadmill 300 and user 1001. The unweighting system 100 is positioned about the treadmill 300 and provides a sufficient running envelope for the user to move within while unweighted and attached to the unweighting system 100. As shown in FIGS. 8A-8D, the components of the unweighting system 100 do not interfere with the user's running form.

Figure 8B:
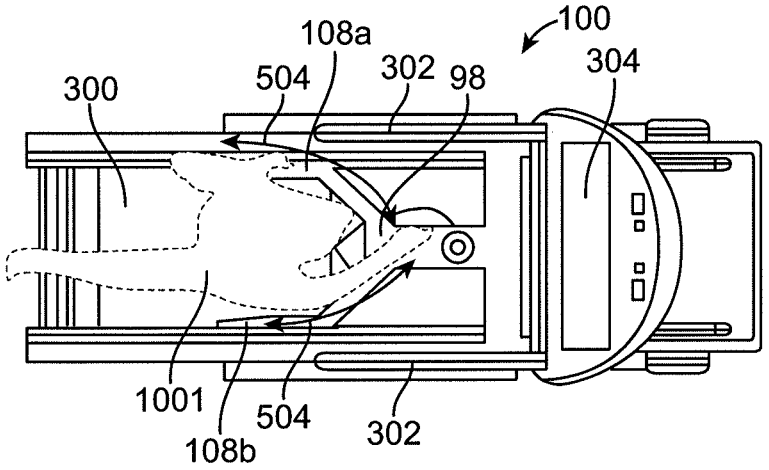
Figure 8C:
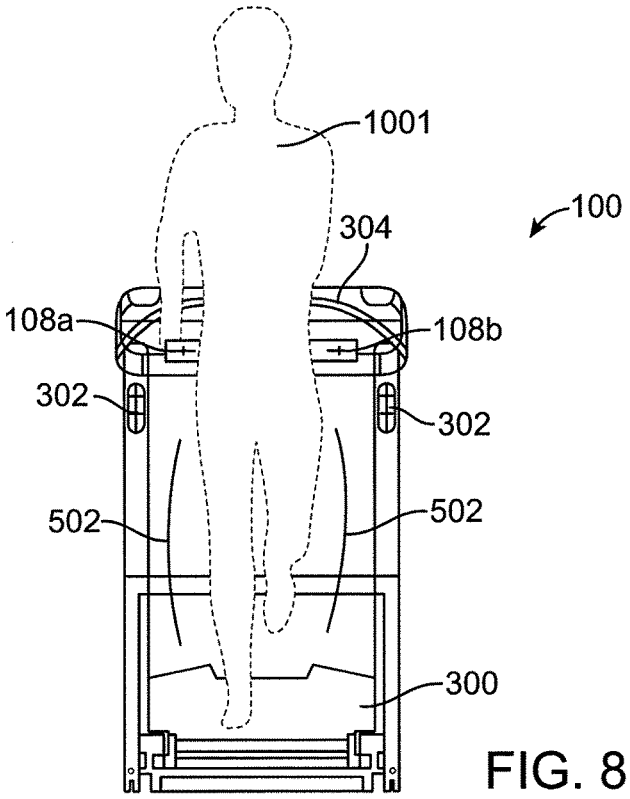
Figure 8D:
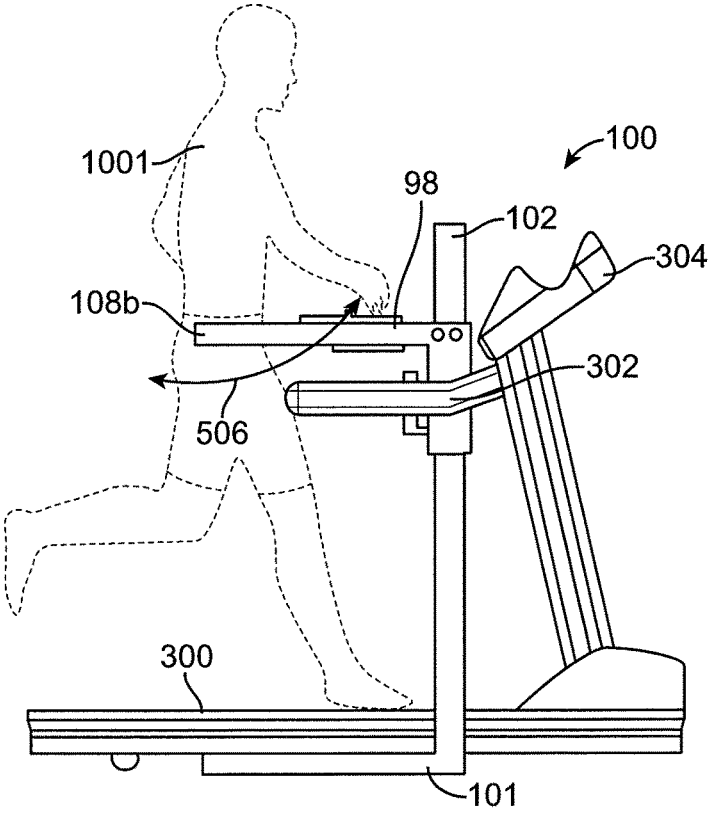

For example, as shown in FIG. 8B, the user's arms can move freely in the area 504 around the user's waist above the arms 108*a-b* of the arm assembly 98 without interference. Similarly, FIG. 8D shows that the arms 108*a-b* of the arm assembly 98 are close enough or contoured to the user's body 1001 to allow the user's arms to move up and down beside the arm assembly 98 without obstruction. As shown, the arms 108*a-b* of the arm assembly 98 are positioned in the space between the user's hips and the user's arms. The user 1001 can move his arms unrestrictedly alongside the outside of each arm 108*a-b* of the arm assembly 98. For example, envelope area 506 is provided along the outside of the arms 108*a-b* for the user's arm swing.

Additionally, the unweighting system 100, including the vertical bar 102 and the arm assembly 98, do not interfere with the movement of the user's legs during motion. Thus, the user's legs can move freely in a running envelope space 502 without obstruction by the unweighting system 100 (shown in FIG. 8C). In particular, because the vertical bar 102 is aligned substantially with the sagittal plane of the user 1001, the user's legs can easily move therearound. Thus, user can run, walk, or otherwise exercise within the exercise envelope 500 provided by the unweighting system. Further, the positioning of the arms 108*a,b* of the arm assembly 98 proximate to the user's hips allows the user to raise his legs during walking or running without hitting the arm assembly 98.

Finally, the position of the arms 108*a-b* of the arm assembly 98 and the vertical bar 102 do not obstruct or interfere with the components of the treadmill 300, such as the treadmill armrest 302 and/or the treadmill control panel 304.

Alternative designs to the unweighting system 100 shown in FIG. 1 are contemplated and within the scope of this disclosure.

Figure 7:
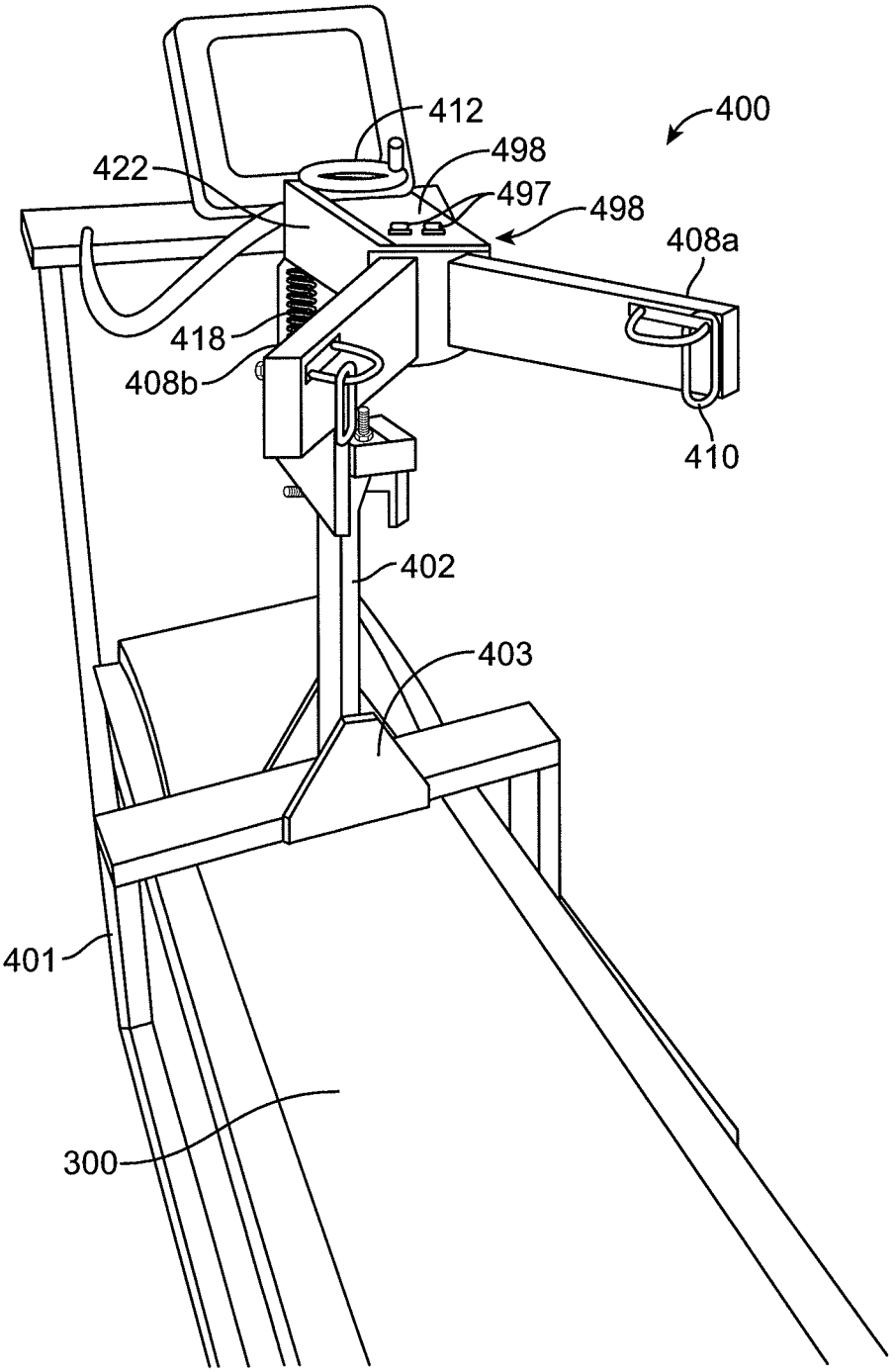
FIG. 7 shows an alternative arm assembly.

For example, the arms of the arm assembly and/or fixation/pivoting mechanisms of the arms of the arm assembly can vary. FIG. 7 shows an unweighting system 400 with an arm assembly 498 that includes arms 408*a,b* that extend straight out from the central beam 422. The arms 408*a-b* can be are attached to the beam by way of pins 497. Further, the arms 408*a,b* may be at a fixed distance that cannot be changed, which may increase stability and fall safety of the system. Alternatively, in some embodiments, each arm 408*a,b* may be configured to pivot laterally about its respective pin 497. For example, an arms 408*a,b* may move toward or away from a central axis between the arms by pivoting about the pin 497. This may further allow the user to adjust the distance between the arms 408*a,b*. Additionally, pins 497 may be loosened or tightened to allow adjustability and locking of the arm distance. The arm assembly 498 can further an attachment mechanism 410 for coupling a user to the unweighting system 400. Like the unweighting system 100 of FIG. 1, the unweighting system 400 also has a frame with a base 401 connected to a vertical bar 402, which is in turn coupled with the arm assembly 498. The unweighting system 400 also includes a spring 418 in contact with a lead nut. The lead nut is in contact with a lead screw that is turned by a knob 412. Turning the lead screw moves the lead nut vertically along the length of the lead screw. When the lead nut contacts the spring 418, the lead nut can compress the spring 418 and reduce the spring length. Additionally, a gusset plate 403 may be used to support and stabilize the vertical bar 402.

Figure 19:
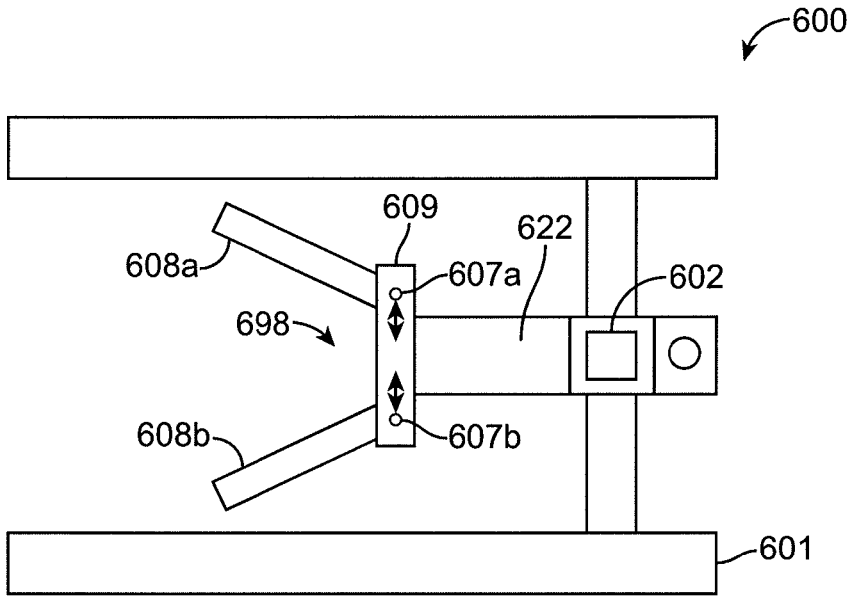
FIG. 19 shows an alternative arm assembly.

Another example of an alternative arm assembly is shown in the unweighting system 600 in FIG. 19. The unweighting system 600 includes a base 601 and a vertical bar 602. The arm assembly 698 is attached to the vertical bar 602. The arm assembly 698 can be attached directly to the vertical bar 602 or by way of a height adjustable fulcrum, as described above. The arm assembly 698 includes a pair of straight arms 608*a-b* attached a bar 609 by pins 607*a-b* respectively. The bar 609 is attached to a central beam 622. In some embodiments, arms 608*a-b* can pivot about the pins 607*a-b* to allow the user to adjust the distance between arms 608*a-b*.

The pins 607*a-b* may be sliding pins that move along the bar 609 to bring the arms 608*a-b* closer or farther apart. This allows the distance between the arms 608*a-b* to be increased or decreased as needed to accommodate user size.

Figure 5:
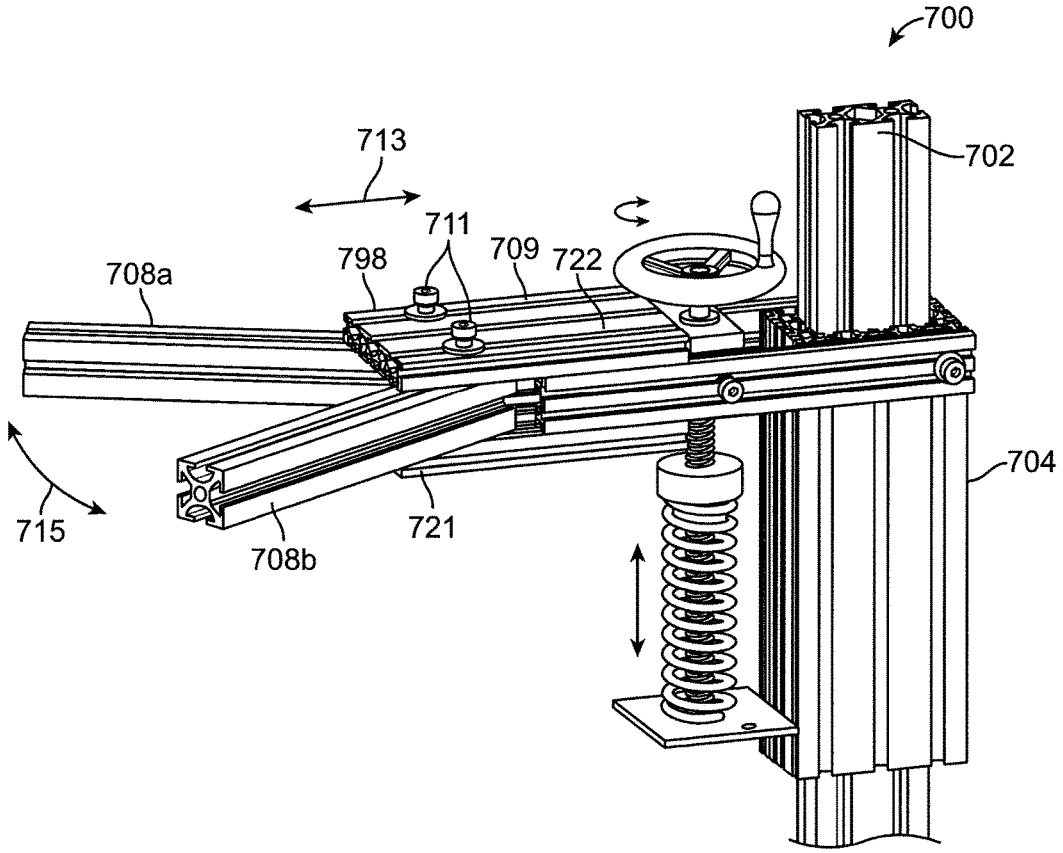
FIG. 5 shows an alternative arm assembly.

Another example of an alternative arm assembly is shown in FIG. 5. The arm assembly 798 of FIG. 5 includes straight arms 708*a,b* and provides an alternative arm width adjustment mechanism. The arms 708*a-b* are sandwiched and pinned between a top plate 709 and a bottom plate 721 of central beam 722. Additionally, the arm assembly 798 includes a recessed portion for receiving the arms 708*a-b* between the two plates 709, 721. A pin 711 attaches the arms 708*a,b* to the top and bottom plates 709, 721. The arms 708*a-b* are designed move the pins 711 to allow the user to adjust the distance between the arms. For example, the system may use sliding pins 711 that can move toward and away from the distal end of the central beam 722. For example, the pins 711 may slide in direction 713 along the plates 709, 721 to accommodate movement of the arms 708*a-b*. The sliding pins 711 may be pushed toward the vertical bar 702 and/or fulcrum 704 to narrow the distance 715 between the arms 708*a-b*. Likewise, the pins 711 may be moved away from the vertical bar 702 and/or the fulcrum 704 to increase the distance between the arms 708*a-b*. In addition the sliding the pins 711 along the plates 709, 721, the arm assembly 798 may also allow the arms to pivot about the pins 711 to adjust the distance between the arms 708*a-b*. The arms 708*a-b* may pivot outward or inward about the pins 711 to adjust the distance between the arms 708*a-b*. Furthermore, the sliding pins 711 may increase the portion of the arms 708*a-b* positioned outside of the plates 709, 721. By moving the pins 711 toward the distal end of the plates 709, 721, a section of an arm 708*a,b* that is inside the recessed portion between the plates 709, 721 may be moved outside of the recessed portion.

Figure 9:
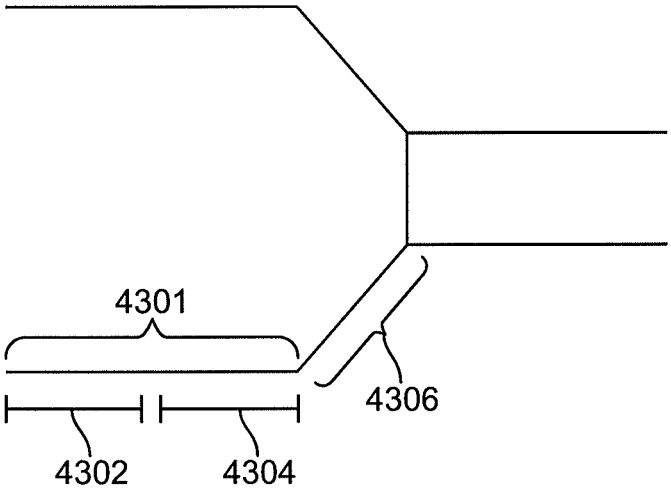
FIGS. 9-11 show an arm assembly with varying thicknesses.
Figure 10:
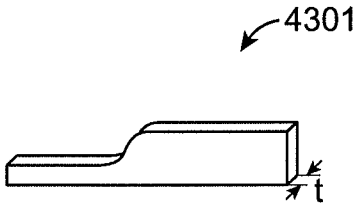
Figure 11:
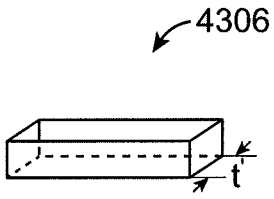

In some embodiments, the arm assemblies can be designed so as to best accommodate the user's arm swing. In some embodiments, the shape of the arm assembly is designed to contour the user's body and minimize intrusion into the arm swing envelope. For example, the arm shape may be straight as shown in FIGS. 1, 5, 7, and 19. The arm may include one straight piece (see FIG. 5) or may include straight sections separated by elbows or wrists (see FIG. 1). Additionally, the arm may also be curved to accommodate the user's exercise envelope. Further, in some embodiments, the arms can be designed to provide the user's body maximum clearance for arm swing by varying the thickness of portions of the arms of the arm assembly. FIGS. 9-11 shows a first arm portion 4301 and a second arm portion 4306. The first arm portion 4301 may have a smaller thickness t relative to the thickness t' of the second portion 4306 to provide room for the user's arm to swing next to the first arm portion 43001. Further, in some embodiments, the portion of the arm 4301 may include sections of different heights or thicknesses. For example, sub-portion 4302 may have a smaller height (as shown) or thickness than sub-portion 4304.

Figure 12:
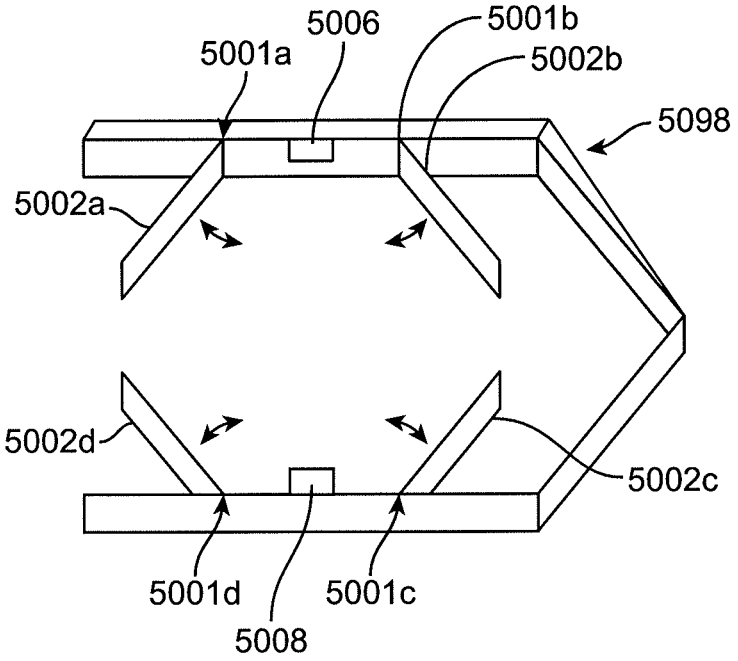
FIG. 12 shows an arm assembly including a plurality of attachment members.
Figure 13:
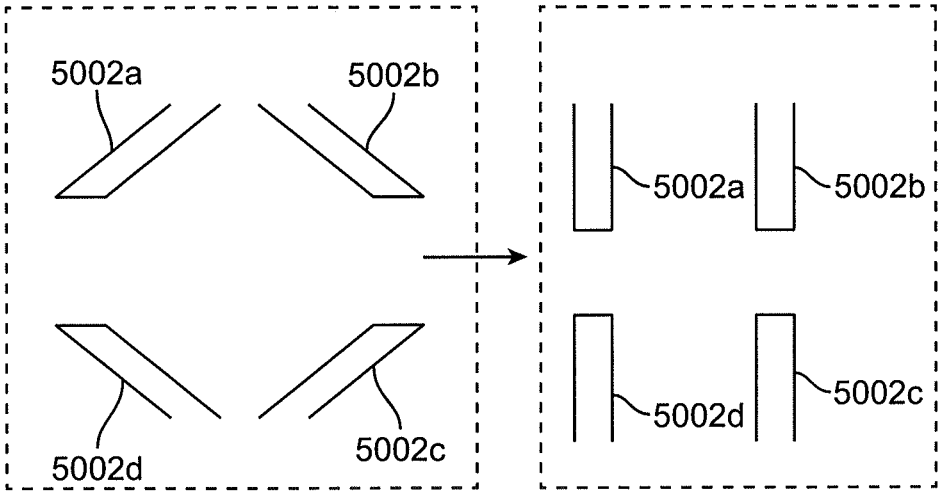
FIG. 13 shows varying space within the arm assembly of FIG. 12.

In some embodiments, attachments points or other supports may be provided to help stabilize the user to ensure proper running form and/or ensure that the user does not fall. FIG. 12 shows an example of an arm assembly 5098 having a plurality of attachment members 5002*a-d*. The attachment members 5002*a-d* can be rods or slats that are attached to the arm assembly 5098 on one end and are free on the other end. Further, the attachment members 5002*a-d* may be moveable. For example, attachment members 5002*a-d* can be attached to the arm assembly 5098 by way of hinges 5001*a-d* that allow the attachment members 5002*a-d* to pivot thereabout. This allows a user to move the attachment members 5002*a-d* to widen or reduce the space enclosed within the members 5002*a-d*, as shown in FIG. 13. In some embodiments, a user can connect to the attachment members by attaching a pair of unweighting shorts to the members 5002*a-d*.

Figure 18A:
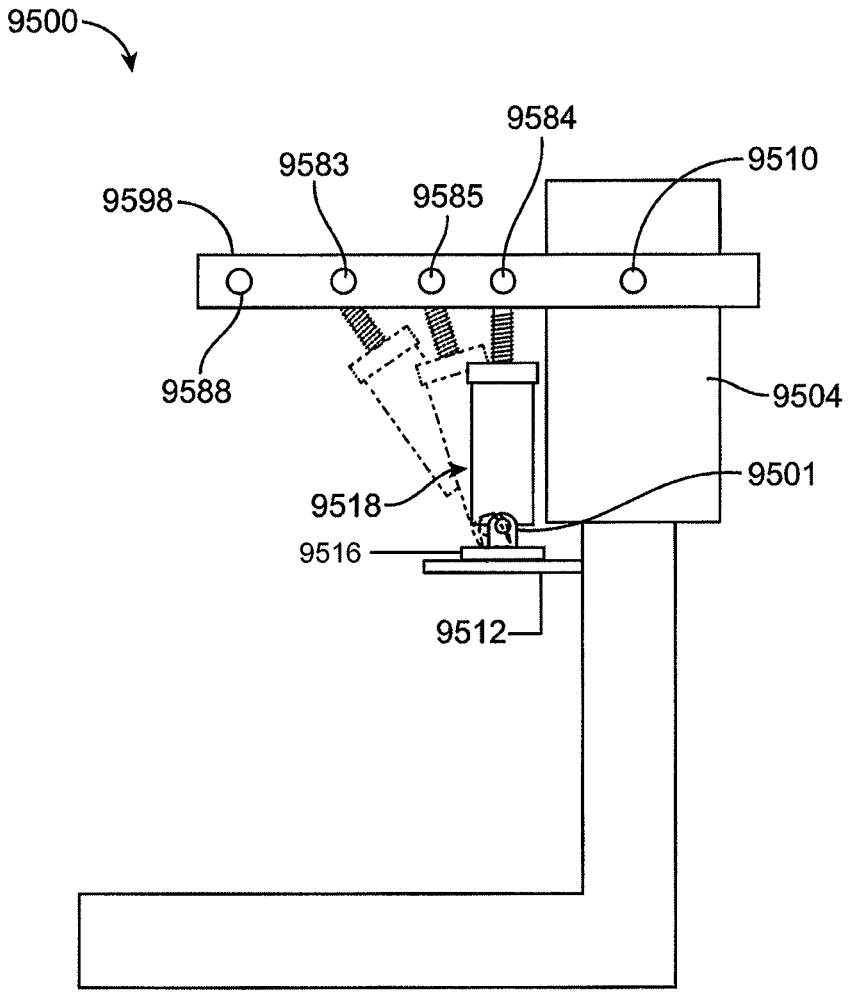
FIGS. 18A-B shows various positions and orientations for a resilient member.

Moreover, as can be appreciated, there are several locations and orientations for the resilient member or spring on the unweighting systems. For example, in some variations, the spring can be positioned such that it is not parallel to the vertical bar 102 (and/or not at a 90 degree angle relative to the arm assembly). Further, in some embodiments, the force imparted by the resilient member is modified by adjusting the angle of the member. Referring to FIG. 18A, an unweighting system 9500 having multiple attachment points for a spring 9518 is shown. The spring 9518 may be attached to a load cell or bottom plate 9512 by way of a pin 9501 that allows angular motion about the pin 9501. The spring 9518 may also be attached at the top to an arm assembly 9598. The arm assembly 9598 is coupled to a fulcrum 9504 at pivot point 9510. The arm assembly 9598 has a user attachment point 9588 at a distal end. Between the pivot point 9510 and the user attachment point 9588 are a plurality of locations where the spring 9518 may attach. For example, the spring 9518 may be attached orthogonal to the arm assembly 9598 at a first position 9584. The spring 9518 may be tilted to change the angle of the spring 9518 by attaching the top of the member to positions 9585 or 9583. In some embodiments, the spring 9518 can be slideably along the arm assembly 9598 to allow continuous adjustment of the position of the spring. The unweighting force exerted can be varied by changing the angle of the spring 9518 relative to the arm assembly 9598.

Figure 18B:
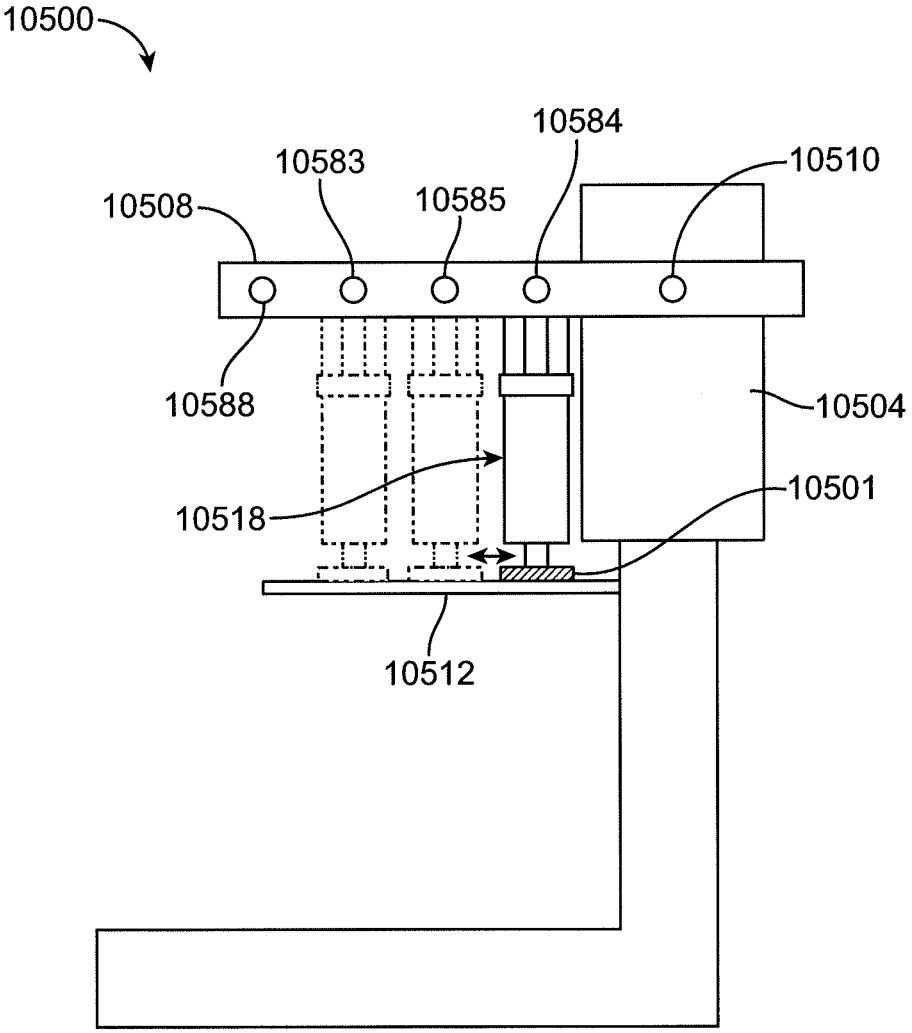

Resilient member or spring location or position may also be adjustable. As shown in FIG. 18B, the unweighting system 10500 includes a plurality of locations for the spring 10518. As shown, the spring 10518 is attached to a sliding block 10501 on a bottom plate 10512. The sliding block 10501 allows the spring 10518 to be moved to any position along the plate 10512. Similarly, the spring 10518 may be attached to any number of positions along the arm 10508. The spring 10518 may be moved from a first position at 10584 to a second position 10585 or third position 10583 on the arm assembly 10598. The spring positions are shown between a user attachment point 10588 and a pivot point 10510. However, in some embodiments, the spring 10518 may be located or attached at these points 10588, 10510 or outside of these points. In some embodiments, force imparted by the spring 10518 may be increased by moving the spring 10518 closer to the user attachment point 10588. Likewise, the force imparted may be reduced by moving the spring 10518 further from the user attachment point 10588 and toward the pivot point 10510.

Figure 15:
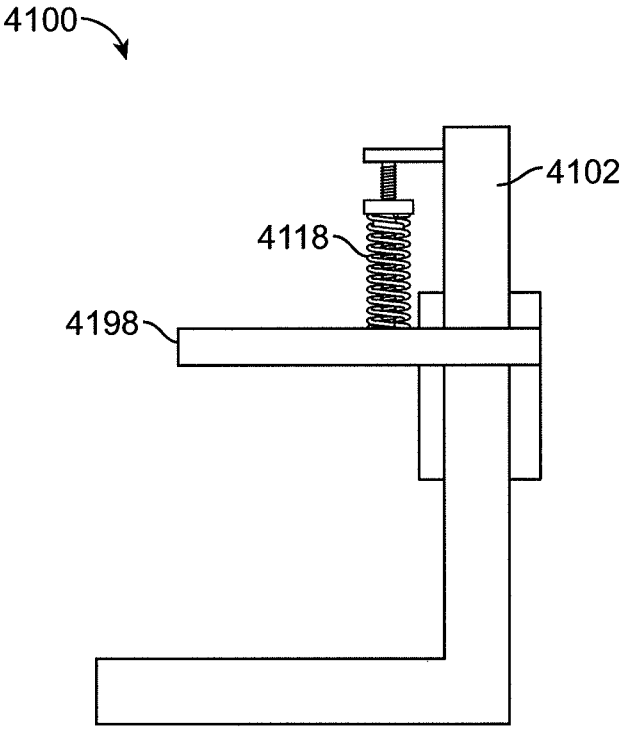
FIG. 15 shows an alternative unweighting system according to embodiments described.
Figure 16:
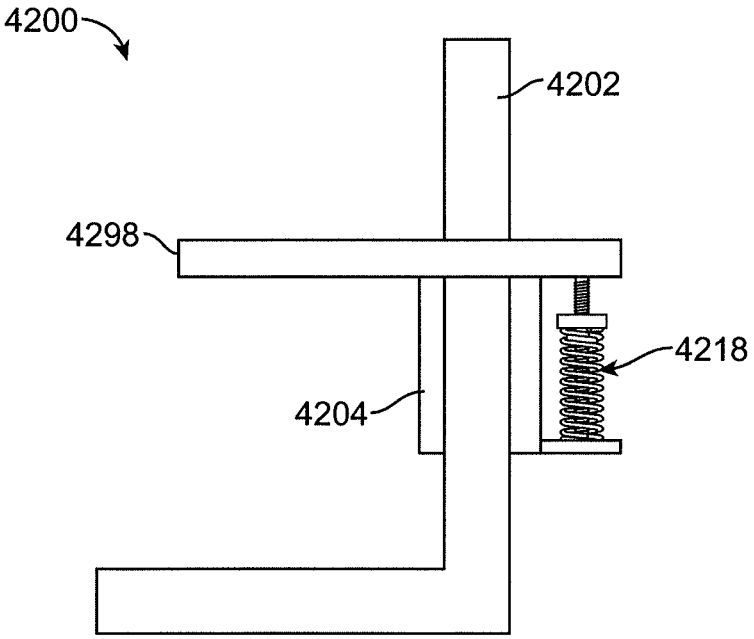
FIG. 16 shows an alternative unweighting system according to embodiments described.

While the springs for the unweighting systems described herein have been described as being positioned below the arm assembly between the user and the vertical bar, other locations are possible. For example, as shown in FIG. 15, the spring/resilient member 4118 of unweighting system 4100 may be above the arm assembly 4198 but still between the user and the vertical bar 4102. By changing the length of the spring 4118, the amount of tension force applied to the arm assembly 4198 can be modified. The length of the spring may be varied by the same methods described above, e.g. lead screw and nut. Referring to FIG. 16, as another example, the vertical bar 4202 of unweighting assembly 4200 can be positioned between the user and the spring 4218 with the spring 4218 below the arm assembly 4298. The arm assembly 4298 can extend beyond the fulcrum 4204 to couple to the spring/resilient member 4218. In still another variation, the vertical bar is between the user and the spring as in FIG. 16, but above the arm assembly (rather than below as in FIG. 16). In some embodiments, the position of the resilient member relative to the fulcrum can determine or control the consistency of the lifting force experienced by the user. Positioning the resilient member closer to the fulcrum provides a relatively constant lifting force by minimizing the length change of the resilient member as the user's hips move vertically. This allows the user to experience consistent unloading while moving in the unweighting system.

In still further variations, a spring may be replaced by or used in combination with another spring or other resilient member/members to provide for adjustable unweighting of a user. Any suitable resilient member that provides an unweighting or lifting force may be used.

In some embodiments, the resilient member is a helical coil spring. In other embodiments, the member is any compliant or resilient member that returns a force when a deflection is applied, with examples including leaf springs, air springs, cantilever springs, disk springs, bands, bungee cords, and others.

Additionally, described embodiments are not limited to unweighting by compressing or shortening the length of a spring. For example, multiple resilient members may be provided where increasing the number resilient members attached to the unweighting system increases the unweighting force. Resilient bands or cords may be used where increasing the number of bands employed increases the amount of unweighting force applied to the user. Advantageously, described embodiments can utilize a single spring element and a single actuator to achieve both the desired unweighting force as well as proper height adjustment. However, it is to be appreciated that the embodiments are not limited to a single resilient member or actuator.

Additionally, the embodiments described herein can include assisted movement and controlled unweighting forces. For assisted movement, the unweighting systems may include means and mechanisms for helping a user enter and couple to the unweighting system. For example, a user who has impaired mobility would benefit from a motorized or manual height adjustment mechanism that maneuvers a user attachment point of the unweighting system to the area of attachment on the user with little or no effort by the user. Suitable height adjustment mechanisms may include a motorized lift that lifts the arm assembly to an area near the user's waist or hips for easy clipping, hooking, etc. to the user's body.

For controlled unweighting, the unweighting systems can include means or mechanisms for controlling the amount of unweighting force experienced by the user throughout the session. These mechanisms including unweighting assemblies or controller systems for varying the unweighting force imparted by a resilient member attached to the unweighting system. Furthermore, in some embodiments, the same mechanism employed may provide both assisted movement and controlled unweighting forces.

Figure 14:
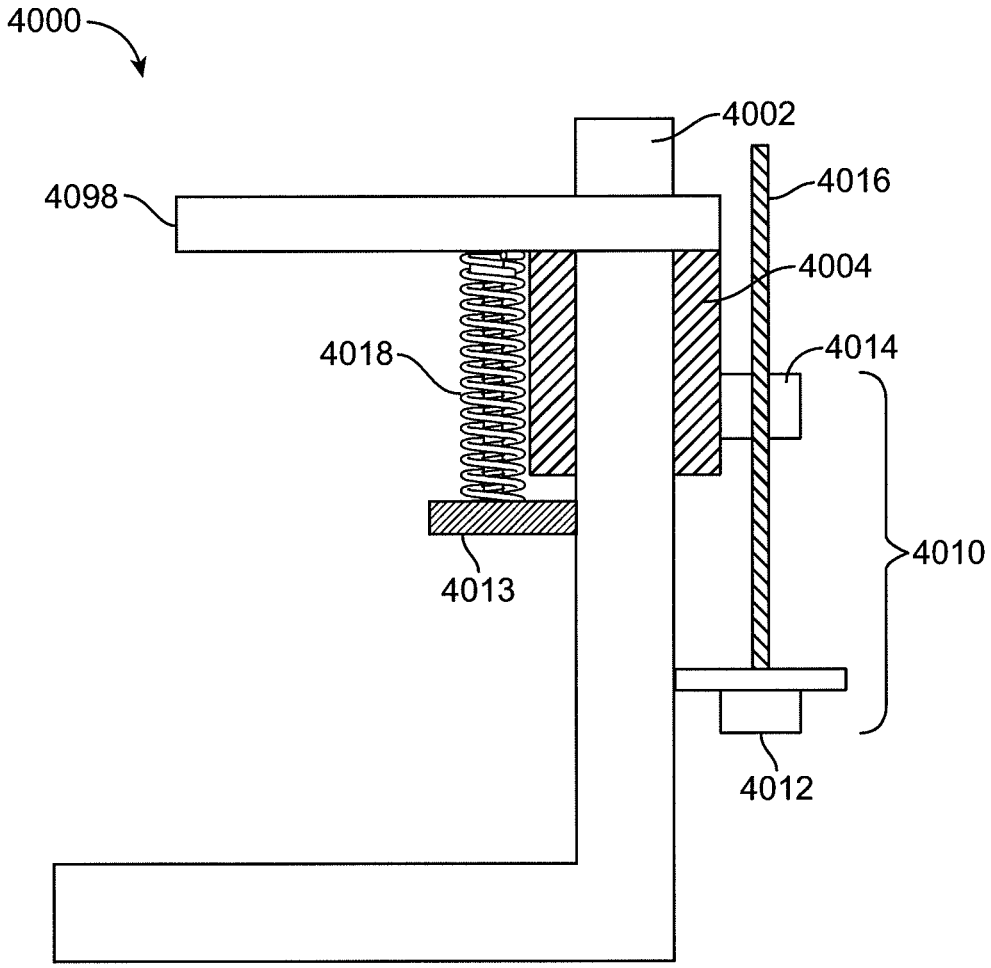
FIG. 14 shows another monocolumn unweighting system.

In some embodiments, the height of the arm assembly and/or the unweighting force applied to the user can be controlled by a motorized or non-electrically powered system. FIG. 14 shows an unweighting system 4000 including a variation on the height adjustment mechanism as well as a controller 410. The unweighting system 4000 thus includes an arm assembly 4098 attached to a height adjustable fulcrum 4004. The height adjustable fulcrum 4004 with attached arm assembly 4098 can move vertically along the vertical bar 4002. The unweighting system 4000 also includes a resilient member, such as a spring 4018, fixed between the arm assembly 4098 and a plate 4013. The unweighting force controller system 4010 has a lead nut 4016, lead screw 4014, and a motor 4012. The lead nut 4016 is attached to the height adjustable fulcrum 4008 of the unweighting system 4000. The lead screw 4016 is threaded through the lead nut 4014 and is coupled to the motor 4012.

In operation, the controller system 4010 controls the unweighting force by changing the length of the spring 4018. This can be accomplished by lowering and raising the arm assembly 4098, which is attached to the spring 4018. For example, the motor 4012 can rotate the lead screw 4016 to result in translational motion by the lead nut 4014. By rotating the lead screw 4016 in a first direction, the lead nut 4014 can be moved up the length of the lead screw 4016. Alternatively, by rotating the lead screw 4016 in a second direction (e.g. opposite the first direction), the lead nut 4014 can be moved down the length of the lead screw 4016. Because the lead nut 4014 is fixed to the height adjustable fulcrum 4004, any vertical movement by the lead nut 4014 also moves the height adjustable fulcrum 4004 up or down along the vertical bar 4002. Consequently, any vertical movement of the height adjustable fulcrum 4004 also moves the attached arm assembly 4098. When the arm assembly 4098 is moved up or down, the length of the spring 4018 is also changed. Raising the arm assembly 4098 will lengthen the spring length or extend the spring 4018. Lowering the arm assembly 4004 will shorten the spring length or compress the spring 4018. This, in turn, allows the user the control the spring force exerted for unweighting the user's load. The controller system 4010 can also be used to adjust the height of the fulcrum 4004 and arm assembly 4098 to assist the user in entering the unweighting system. The arm assembly 4098 may be raised or lowered by the controller system 4010 such that the arm assembly 4098 is near or at the user's hips/waist. The user can then attach himself to the arm assembly by way of clips, hooks, etc. on a worn unweighting garment such as a pair of unweighting shorts.

Figure 20:
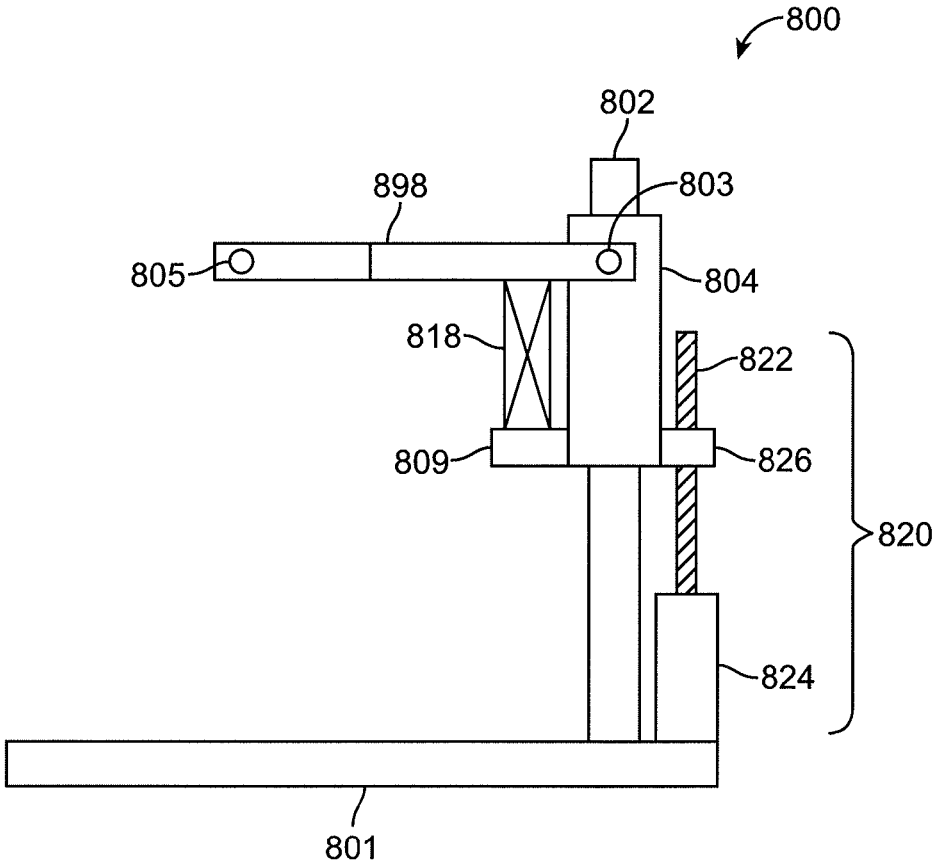
FIG. 20 shows another monocolumn unweighting system.

FIG. 20 illustrates an unweighting system 800 with an alternative controller system 820 and an alternative height adjustment mechanism for controlling the height of the arm assembly 808 and the unweighting force. The unweighting system 800 includes a frame with a base 801. The base 801 is attached to a vertical bar 802. A sliding sleeve or fulcrum 804 is moveably attached to the vertical bar 802. An unweighting arm assembly 898 is attached to the fulcrum 804 at a pivot point 803. The distal end of the arm assembly 898 includes a user attachment point 805 for coupling a user to the arm 898. A resilient member 818 is located between the arm assembly 898 and a plate 809. The plate 809 is attached to the fulcrum 804. The controller system 820 includes a lead screw 822, a lead nut 826 connected to the fulcrum 804 and/or plate 809, and a drive motor 824. When the lead nut 826 is moved linearly up and down along the vertical bar 802, the attached fulcrum 804 (and arm assembly 898) also moves along the vertical bar 802. The controller system 820 can thus be used to adjust the height of the arm assembly 898 to assist a user in coupling to the unweighting system 800. That is, the user can raise or lower the arm assembly 898 using the control system 820 until the arm assembly 898 is in a suitable position near the user's hips or waist. The user can then attach himself at the user attachment point 805 as described above. The user can then raise the fulcrum 804 and arm 898 such that the spring 818 begins to exert a lifting force against the user. In some cases, the user raises the fulcrum 804 and arm 898 to a sufficient height such that the user's weight at the user attachment point 805 compresses the spring 818. The control system 820 may be manually operated such as by use of a crank or knob to rotate the lead screw 822. The controller system 820 may also be motorized to provide a motor/actuator driven screw to the move the sliding sleeve 802 and thereby provide height adjustment for the arm 808.

In some embodiments, a counterweight such as those described in patent application Ser. No. 12/778,747, entitled Differential Air Pressure Systems, filed on May 12, 2010 may be used to assist the user's access or control the unweighting force.

In use, a user can step onto the unweighting assembly described herein such that the vertical bar and arm assemblies are positioned in front of the user. The user can then attach himself to the unweighting system, such as by attaching a portion of a worn article of clothing to the arm assembly. As shown in FIG. 1, the arm assembly 98 includes attachment elements 110 that can mate or otherwise mechanically couple the user to the arm assembly 98. The user may wear a pair of shorts with fittings, hooks, clips, loops, etc. that can couple to the attachment elements 110.

Prior to attachment, the user may also adjust the height of the arm assembly and/or width of the arm assembly. In some cases, the user adjusts the arm assembly to a position near the user's hips. As described above, the arm assembly 98 can be adjusted by multiple mechanisms. In one embodiment, the user moves the arm assembly 98 independently of the height adjustable fulcrum 104. In other embodiments, the height adjustable fulcrum 104 moves with the arm assembly 98 along the vertical bar 102. In some embodiments, the height adjustment does not need to be set prior to the user entering the system. Rather, the user can attach to the system and then adjust the width of the arms and the height of the fulcrum.

Once attached to the unweighting system, the spring or resilient member provides an upward lifting force that unloads a portion of the user's weight. The spring force is adjustable by, for example, varying the length of the spring. For example, the spring force can be adjusted by using a lead screw 113 and nut 114 (see FIG. 4) to compress the spring. The user can adjust the spring length or compression by turning a knob 112 to rotate the lead screw and move the lead nut up and down the lead screw. This, in turn, changes the spring length. In some embodiments, changing the spring length or compressing the spring provides varying unweighting to the user depending on the amount of spring compression. Greater spring compression leads to greater unloading. In some embodiments, the amount of unloading is proportional to the amount of compression and inversely proportional to the spring length. The user can increase or decrease unweighting during exercise or movement in the system.

In other embodiments, while the user runs or walks on the unweighting system, the arm assembly 98 pivots vertically (see FIG. 4) to accommodate the shifting of the user's hips while in motion. In other embodiments, the unweighting systems comprise a spring that imparts forces varying with height. For example, as a user walks or runs, the approximately three to four inches of vertical motion of their hips will result in spring length changes that create an unweighting force variance.

In some embodiments, the attachment of the user to the vertical bar 102 via arm assembly 98 can be the only attachment mechanism, and the only unloading, provided to the user during exercise.

Advantages of the described system include height adjustability, a substantially constant lifting force that does not change during the work's workout session (in some embodiments, due to the spring being placed close to the vertical bar), and/or adjustment of the spring length, and thus the amount of unweighting during use.

Additionally, in some embodiments, the described systems provide fall safety and natural running motion. Embodiments described above provide stable structures such as a lockable arm assembly that both controls lateral motion to prevent falls and, at the same time, provides vertical flexibility to allow the user's hips to move naturally up and down during exercise. Additionally, fall safety is provided by allowing users to fall forward and naturally grab the device. For example, some of a user's weight may be transferred to the structure which reduces the amount of weight the spring system has to support. The result is that there is minimal depression of the weight support arm system. There is also positional stability as the users shorts are connected to the arm assembly.

Another advantage of the unweighting systems described is the potential for tracking of the unloaded weight. In some embodiments, a load cell measures the unweighted load and allows the user to monitor the degree of unweighting in real-time, e.g. sampled or averaged way. For example, in some embodiments, there is a load cell at the base of the spring.

Additionally, the embodiments described herein can provide unweighting from a user's hip area. Instead of overhead suspension, the embodiments described can provide attachment points to the user at or near the hip to provide a lifting force from the hip area. The force may be in any direction or angle, including a lateral and/or upward force. In further embodiments, the arm assembly is configured to unweight the user from the hip area.

Unweighting force variability, or the amount that the unweighting force changes as the user moves up and down, is another important characteristic of a rehab and exercise unweighting system. In some embodiments, the unweighting force variability of the unweighting systems described herein, expressed in pounds per inch, is between zero and about 10 pounds per inch. In some embodiments, this unweighting force variability at the user is related to the load/deflection spring rate of the spring by the ratio of the distances between the arm assembly pivot and the user attachment point, and the arm assembly pivot and the lead screw attachment point. In other embodiments, both the unweighting force variability and the unweighting force can be varied by changing this ratio. In still other embodiments, both the unweighing force variability and the unweighting force can be varied by changing the angle at which the lead screw intersects the arm assembly.

Advantageously, the fixable or fixed lateral positioning of the unweighting system, including the lockable positioning of the unweighting arm assembly, provides controlled lateral stability. Cord based systems employed to date over treadmills do little to prevent users from moving side to side, requiring that constant attention be paid. While this is not a problem for able bodied runners and walkers who are intent on what they are doing, the ability to capture a broader spectrum of users relies on the ability for less able users and those who wish to turn their attention elsewhere be accommodated. As such, embodiments contemplated provide for lockable or fixed arm assemblies, as described above and below, that provide fall safety and movement stability during use.

Another advantage of the adjustable arm assembly is the ability to maintain bilateral symmetry between the arms and the user's central axis in order to stabilize the user in situations where the user may be walking or running in a forward or backwards direction.

As for additional details pertinent to the present invention, materials and manufacturing techniques may be employed as within the level of those with skill in the relevant art. The same may hold true with respect to method-based aspects of the invention in terms of additional acts commonly or logically employed. Also, it is contemplated that any optional feature of the inventive variations described may be set forth and claimed independently, or in combination with any one or more of the features described herein. Likewise, reference to a singular item, includes the possibility that there are plural of the same items present. More specifically, as used herein and in the appended claims, the singular forms "a," "and," "said," and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs. The breadth of the present invention is not to be limited by the subject specification, but rather only by the plain meaning of the claim terms employed.

What is claimed is:

1. An unweighting system for adjustably unloading a user's weight comprising:

a height adjustable fulcrum;

a frame comprising a base and a vertical bar adapted to be coupled to the height adjustable fulcrum;

an arm assembly coupled to the height adjustable fulcrum, wherein the arm assembly is adapted to receive and couple to the user; and a movable resilient member attached to the height adjustable fulcrum configured to unload a portion of the user's weight by compressing the resilient member.

2. The system of claim 1, wherein the unweighting system further comprises a lead screw and a lead nut.

3. The system of claim 1, wherein the unweighting system further comprises a load cell.

4. The system of claim 1, wherein the unweighting assembly is configured to vary the resilient member length.

5. The system of claim 1, wherein an amount of force provided by the resilient member is adjusted by changing the height of the arm assembly.

6. The system of claim 1, wherein the height adjustable fulcrum is adapted to move vertically along the vertical bar.

7. The system of claim 1, wherein the arm assembly is adapted to pivot about the fulcrum.

8. The system of claim 1, wherein the resilient member is adapted to support the arm assembly.

9. The system of claim 1, wherein the resilient member is located at a distance to the fulcrum sufficient to result in a constant lifting of the user in response to an adjustment to the resilient member.

10. The system of claim 1, wherein the resilient member length along a longitudinal axis of the resilient member is adjustable.

11. The system of claim 10, wherein adjustment of the resilient member length along the longitudinal axis of the resilient member varies a lifting force experienced by the user.

12. The system of claim 1, further comprising an exercise device.

13. The system of claim 1, further comprising a motorized actuator adapted to compress the resilient member.

* * * * *